US009997871B2

(12) United States Patent
Zhong et al.

(10) Patent No.: US 9,997,871 B2
(45) Date of Patent: Jun. 12, 2018

(54) ELECTRICAL CABLE CONNECTOR WITH GROUNDING SHEET

(71) Applicant: FOXCONN INTERCONNECT TECHNOLOGY LIMITED, Grand Cayman (KY)

(72) Inventors: Wei Zhong, Kunshan (CN); Jian-Kuang Zhu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days. days.

(21) Appl. No.: 15/665,455

(22) Filed: Aug. 1, 2017

(65) Prior Publication Data

US 2018/0034215 A1 Feb. 1, 2018

(30) Foreign Application Priority Data

Aug. 1, 2016 (CN) ..... 2016 1 0618290

(51) Int. Cl.

*H01R 13/6597* (2011.01)
*H01R 24/60* (2011.01)
*H01R 13/6586* (2011.01)
*H01R 107/00* (2006.01)

(52) U.S. Cl.

CPC ..... *H01R 13/6597* (2013.01); *H01R 13/6586* (2013.01); *H01R 24/60* (2013.01); *H01R 2107/00* (2013.01)

(58) Field of Classification Search

CPC .... H01R 13/52; H01R 13/502; H01R 13/514; H01R 13/6581; H01R 13/6585; H01R 13/6591; H01R 13/6594; H01R 24/60

USPC ..... 439/607.05, 607.09, 607.11

See application file for complete search history.

(56) References Cited

U.S. PATENT DOCUMENTS 6,231,355 B1 * 5/2001 Trammel ..... H01R 13/6585 439/79
6,749,468 B2 * 6/2004 Avery ..... H01R 13/518 439/607.05
6,764,342 B2 * 7/2004 Murayama ..... H01R 4/023 439/607.1
6,951,487 B2 * 10/2005 Ozai ..... H01R 9/032 439/637
8,764,488 B2 * 7/2014 Zeng ..... H01R 13/6585 439/108
8,858,243 B2 * 10/2014 Luo ..... H01R 13/652 439/108

(Continued)

FOREIGN PATENT DOCUMENTS

CN 205141284 U 4/2016

*Primary Examiner* — Edwin A. Leon
*Assistant Examiner* — Oscar Jimenez
(74) *Attorney, Agent, or Firm* — Wei Te Chung; Ming Chieh Chang

(57) ABSTRACT

A first terminal module and a second terminal module are integrally assembled with the base, and each of the first terminal module and the second terminal module includes the insulator and the corresponding terminals embedded therein. The first terminal module and the second terminal module are stacked with each other with a metallic shielding plate therebetween. The shielding plate includes front spring fingers and rear spring fingers respectively mechanically and electrically connected with the contacting sections and connecting sections of the respective grounding terminals.

20 Claims, 34 Drawing Sheets

(56) References Cited

U.S. PATENT DOCUMENTS

| | | | | |
|---|---|---|---|---|
| 9,257,801 | B2 | 2/2016 | Fang et al. | |
| 9,337,585 | B1 * | 5/2016 | Yang | H01R 13/6583 |
| 9,496,657 | B1 * | 11/2016 | Chang | H01R 13/6471 |
| 9,520,680 | B2 * | 12/2016 | Hsu | H01R 13/658 |
| 9,590,363 | B2 * | 3/2017 | Wu | H01R 13/6585 |
| 9,640,915 | B2 * | 5/2017 | Phillips | H01R 13/6471 |
| 9,666,996 | B2 * | 5/2017 | Hsu | H01R 13/6585 |
| 9,692,183 | B2 * | 6/2017 | Phillips | H01R 13/6471 |
| 9,768,568 | B1 * | 9/2017 | Jin | H01R 24/60 |
| 2004/0224559 | A1 * | 11/2004 | Nelson | H01R 13/514 439/607.05 |
| 2011/0151716 | A1 * | 6/2011 | Kondo | H01R 13/6658 439/607.01 |
| 2014/0024257 | A1 | 1/2014 | Castillo et al. | |
| 2014/0194005 | A1 * | 7/2014 | Little | H01R 13/6585 439/607.28 |
| 2014/0248785 | A1 * | 9/2014 | Little | H01R 13/6585 439/95 |
| 2016/0006182 | A1 * | 1/2016 | Patel | H01R 13/652 439/108 |
| 2016/0049752 | A1 * | 2/2016 | Qian | H01R 13/6585 439/607.05 |
| 2016/0149349 | A1 * | 5/2016 | Kao | H01R 13/6586 439/607.05 |
| 2016/0149350 | A1 * | 5/2016 | Kao | H01R 12/724 439/607.05 |
| 2017/0352991 | A1 * | 12/2017 | Lin | H01R 13/6591 |
| 2018/0034216 | A1 * | 2/2018 | Zhong | H01R 13/6597 |
| 2018/0034218 | A1 * | 2/2018 | Zhu | H01R 24/60 |

* cited by examiner

ELECTRICAL CABLE CONNECTOR WITH GROUNDING SHEET

BACKGROUND OF THE DISCLOSURE

1. Field of the Disclosure

The invention is related to an electrical cable connector, and particularly to the cable connector equipped with a shielding plate between two rows of cables. The instant application is related to a copending application having the same applicant, the same inventors, the same assignee and the same filing date with a title of "ELECTRICAL CONNECTOR WITH WIRES SOLDERED UPON CONTACT TAILS AND EMBEDDED WITHIN INSULATOR".

2. Description of Related Arts

U.S. Pat. No. 9,257,801 discloses an electrical connector having a conductive shell, the terminal module assembled in the conductive shell and the shielding plate wherein the terminal module has a first terminal module and a second terminal module each having the corresponding conductive terminals therein, and the shielding plate is located between the first terminal module and the second terminal module and electrically and mechanically connected to the conductive shell. Anyhow, no direct connection occurs between the shielding plate and the grounding terminals of the conductive terminals.

It is desired to provide an improved connector with the shielding plate mechanically and electrically connected to the corresponding grounding terminals in a reliable and robust manner.

SUMMARY OF THE DISCLOSURE

To achieve the above desire, an electrical cable connector includes a base, a plurality of terminals and an insulative block. The base includes a main body and a mating tongue extending forwardly from the main body. The mating tongue includes opposite mating faces. The terminal includes a front contacting section exposed upon the mating face, and a rear connecting section. All the terminals include the grounding terminals, the signal terminals and the power terminals. A first terminal module and a second terminal module are integrally assembled with the base, and each of the first terminal module and the second terminal module includes the insulator and the corresponding terminals embedded therein. The first terminal module and the second terminal module are stacked with each other with a metallic shielding plate therebetween. The shielding plate includes front spring fingers and rear spring fingers respectively mechanically and electrically connected with the contacting sections and connecting sections of the respective grounding terminals.

DETAILED DESCRIPTION OF THE PREFERRED EMBODIMENT

Figure 1:
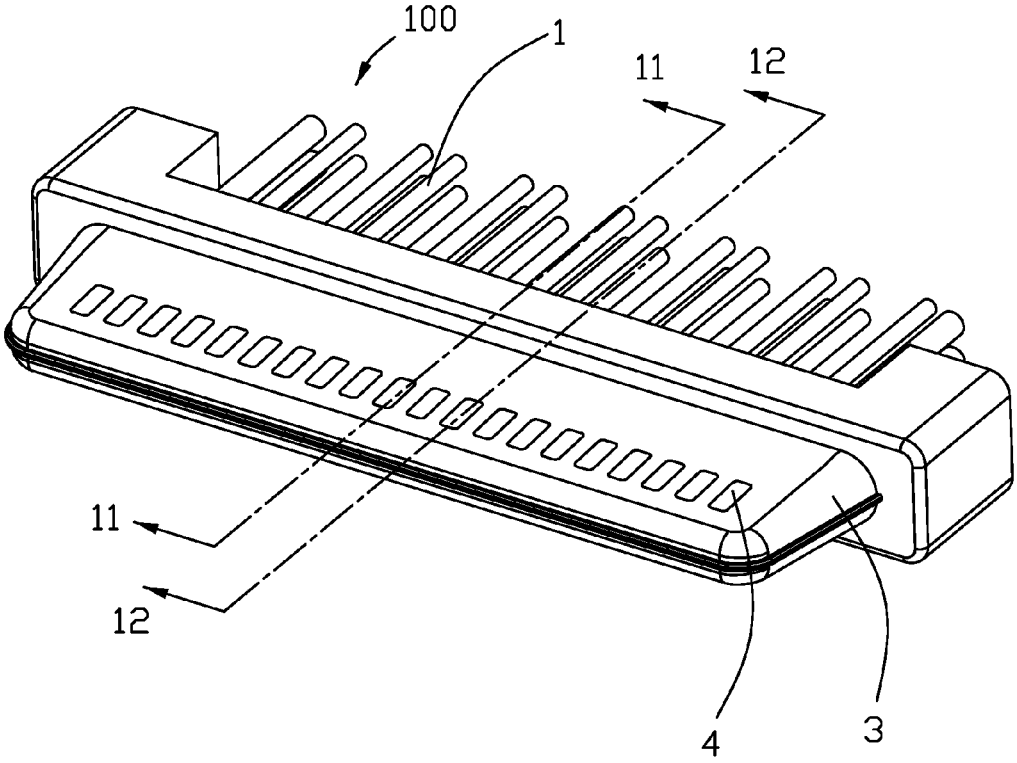
FIG. 1 is a perspective view of an electrical cable connector of the invention according to the first embodiment.
Figure 2:
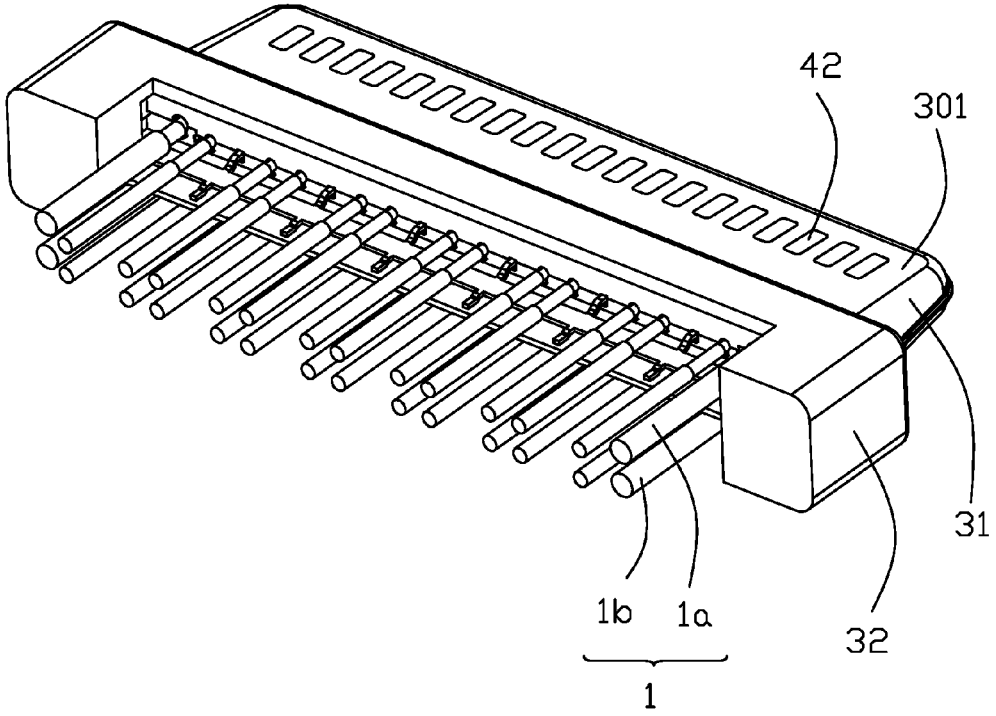
FIG. 2 is another perspective view of the electrical cable connector of FIG. 1.
Figure 3:
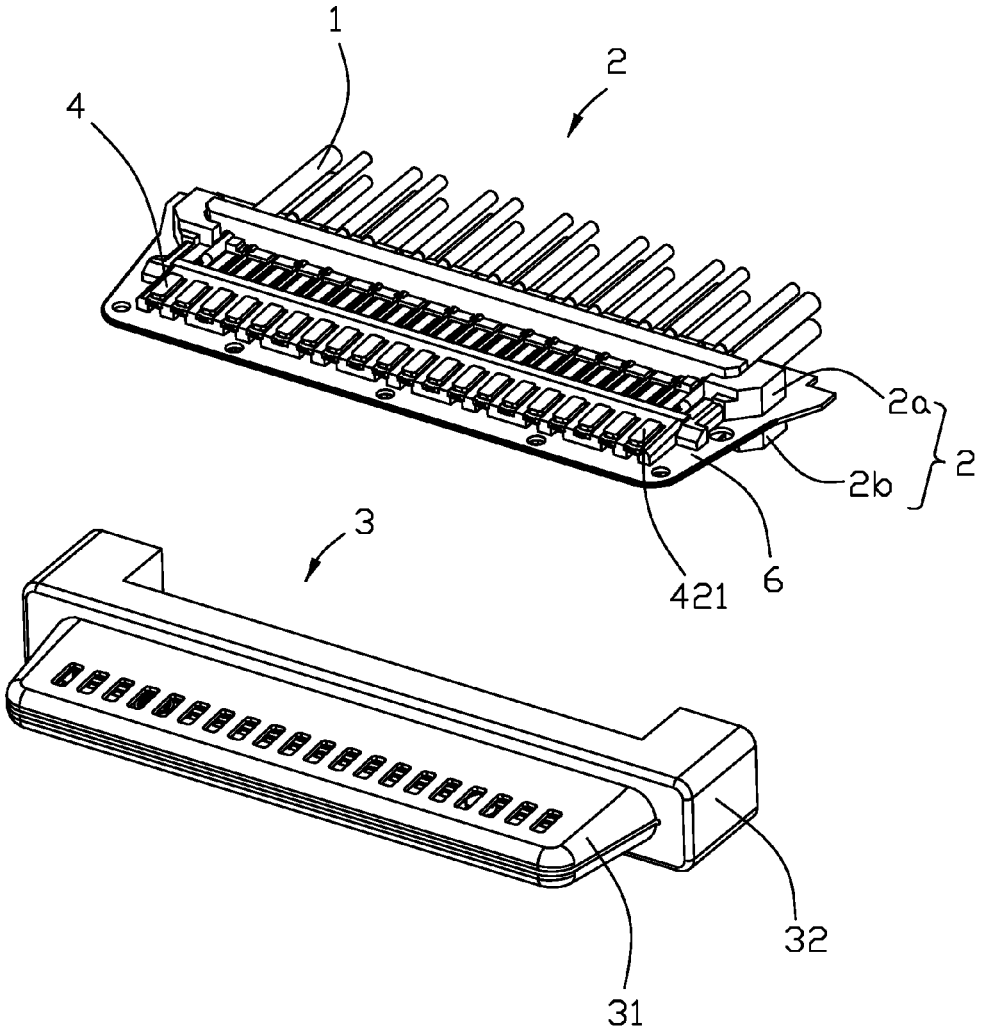
FIG. 3 is an exploded perspective view of the electrical cable connector of FIG. 1.
Figure 4:
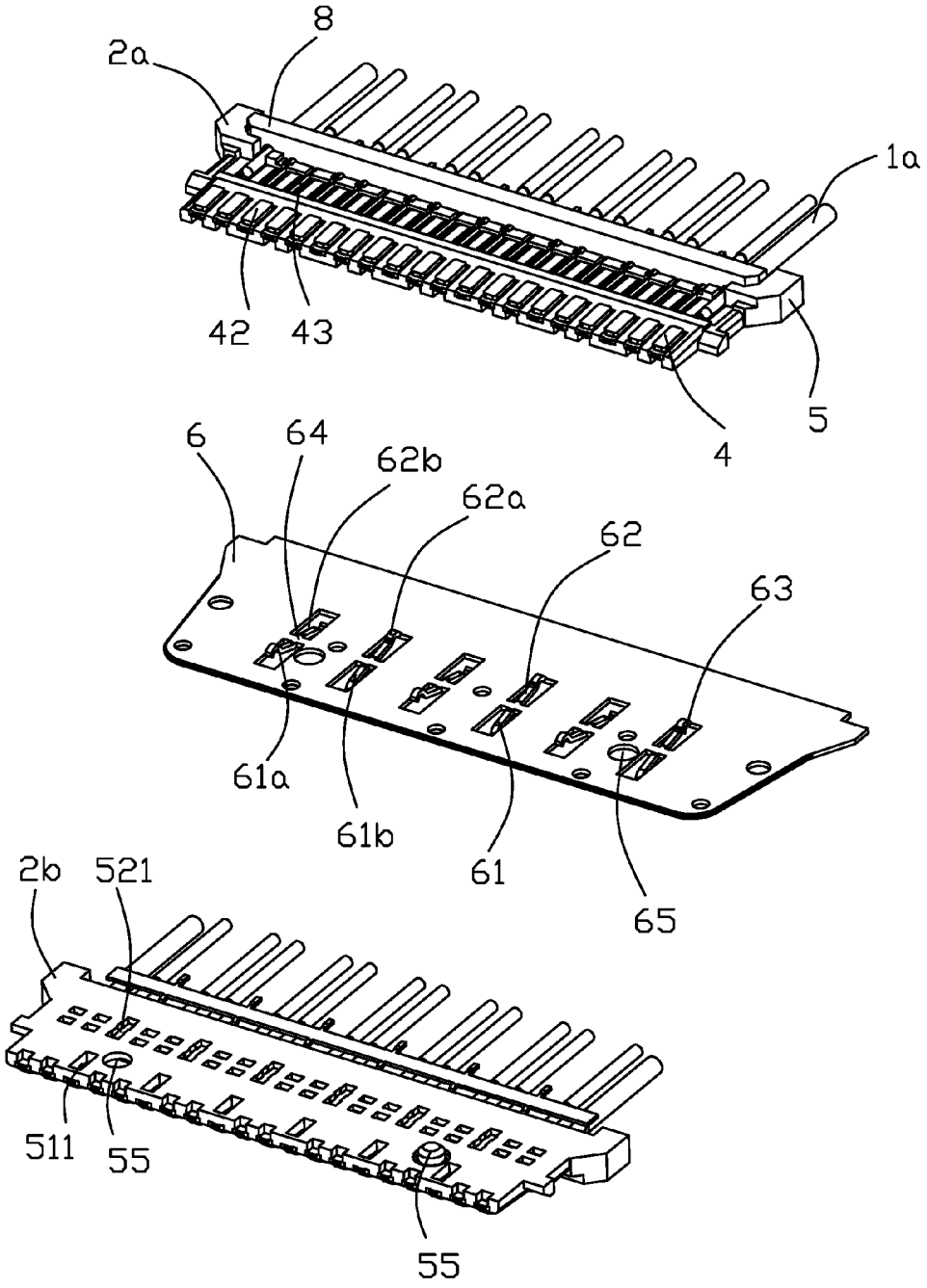
FIG. 4 is a further exploded perspective view of the contact module of the electrical cable connector of FIG. 3.
Figure 5:
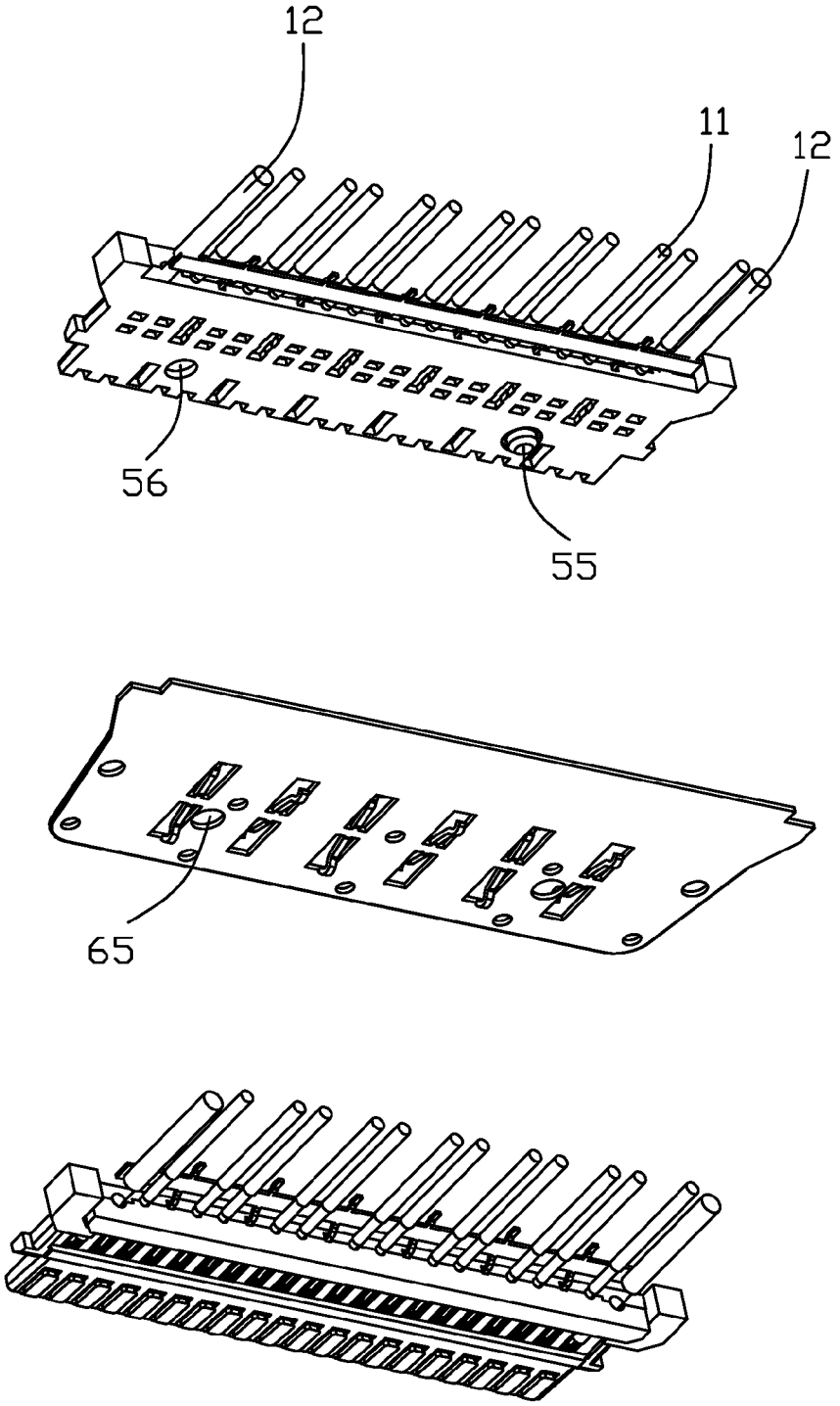
FIG. 5 is another exploded perspective view of the contact module of the electrical cable connector of FIG. 4.
Figure 6:
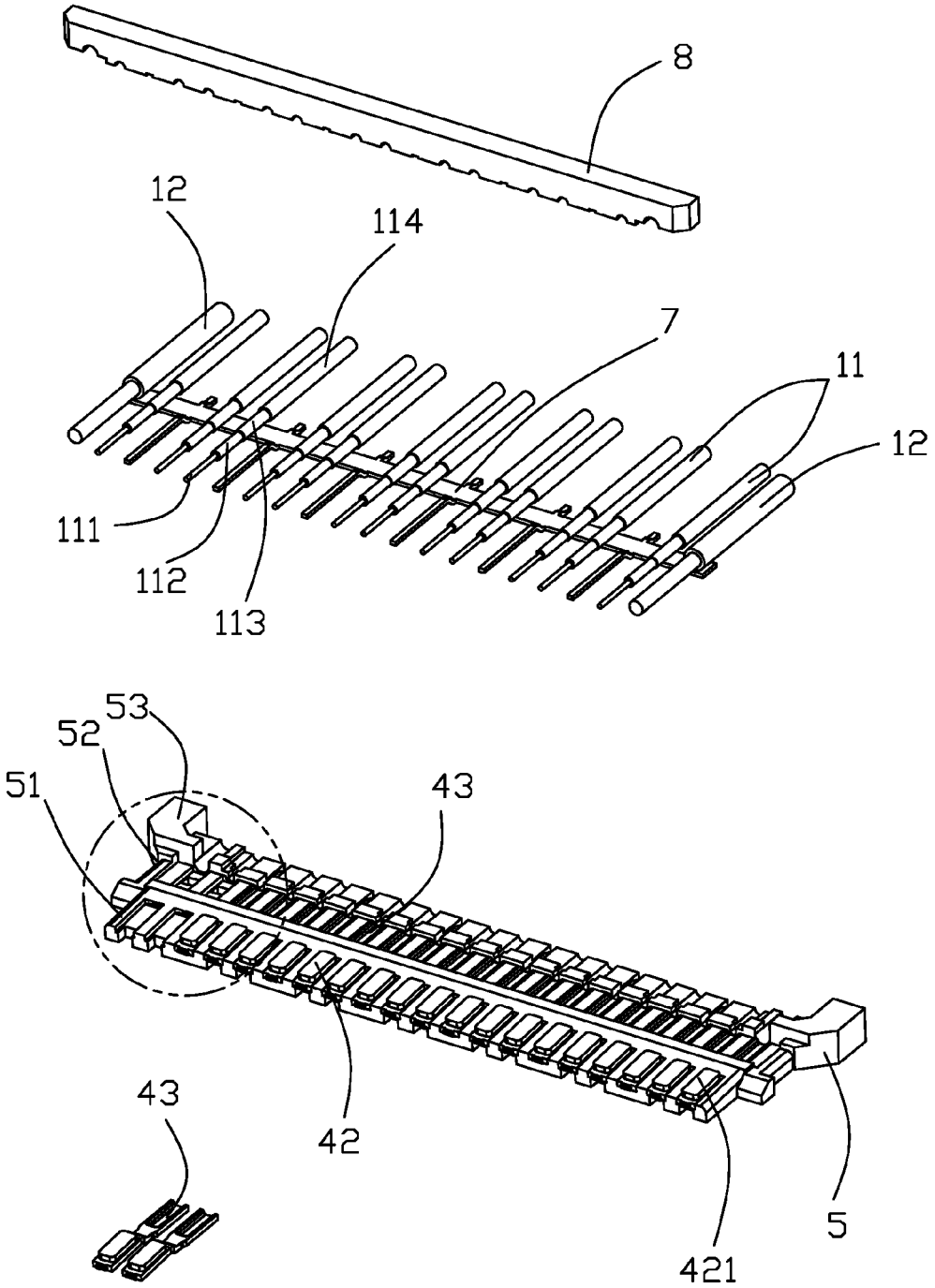
FIG. 6 is an further exploded perspective view of the upper terminal module of the contact module of the electrical cable connector of FIG. 4.
Figure 7:
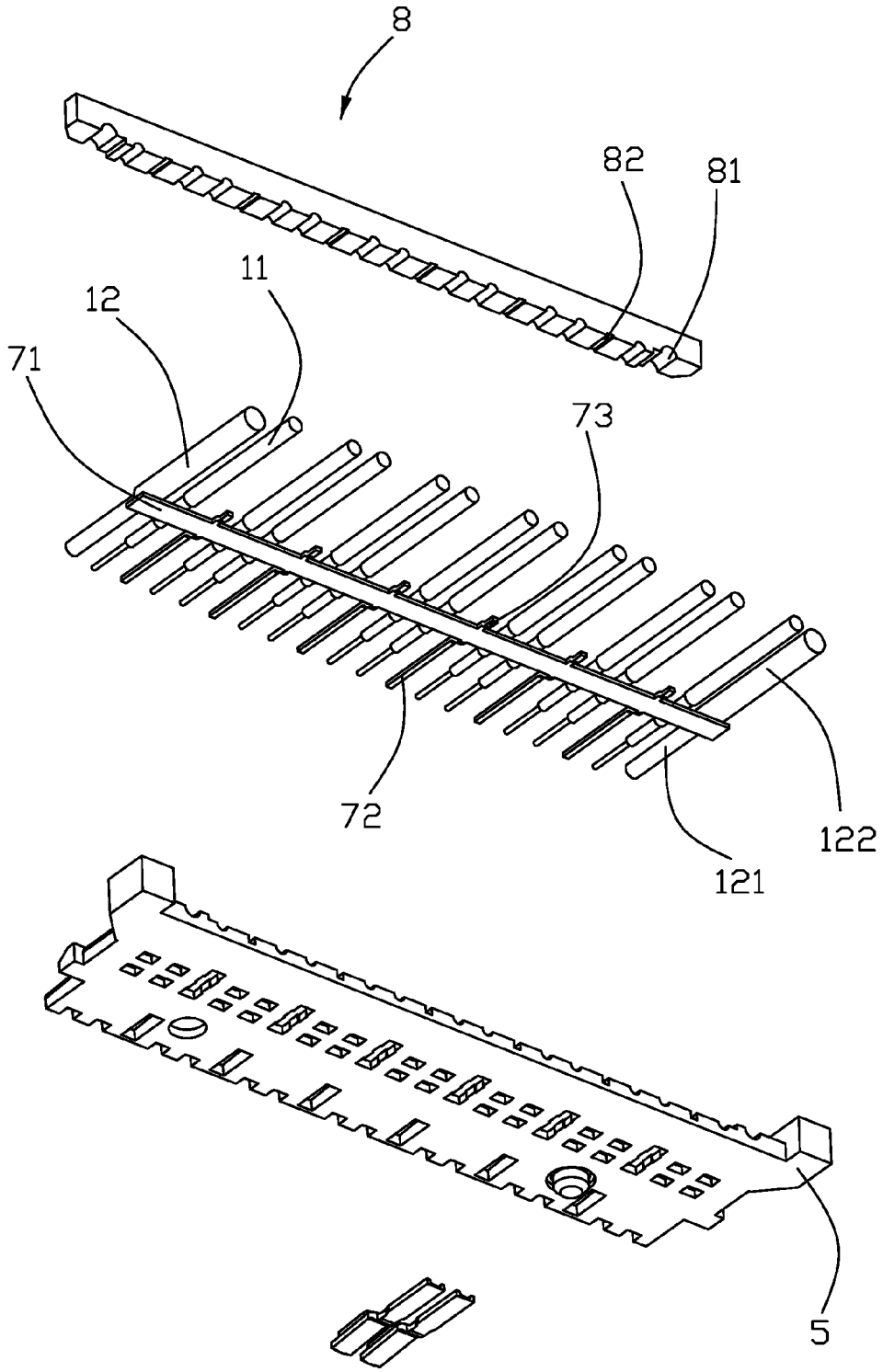
FIG. 7 is another perspective view of the upper terminal module of the contact module of the electrical cable connector of FIG. 6.
Figure 8:
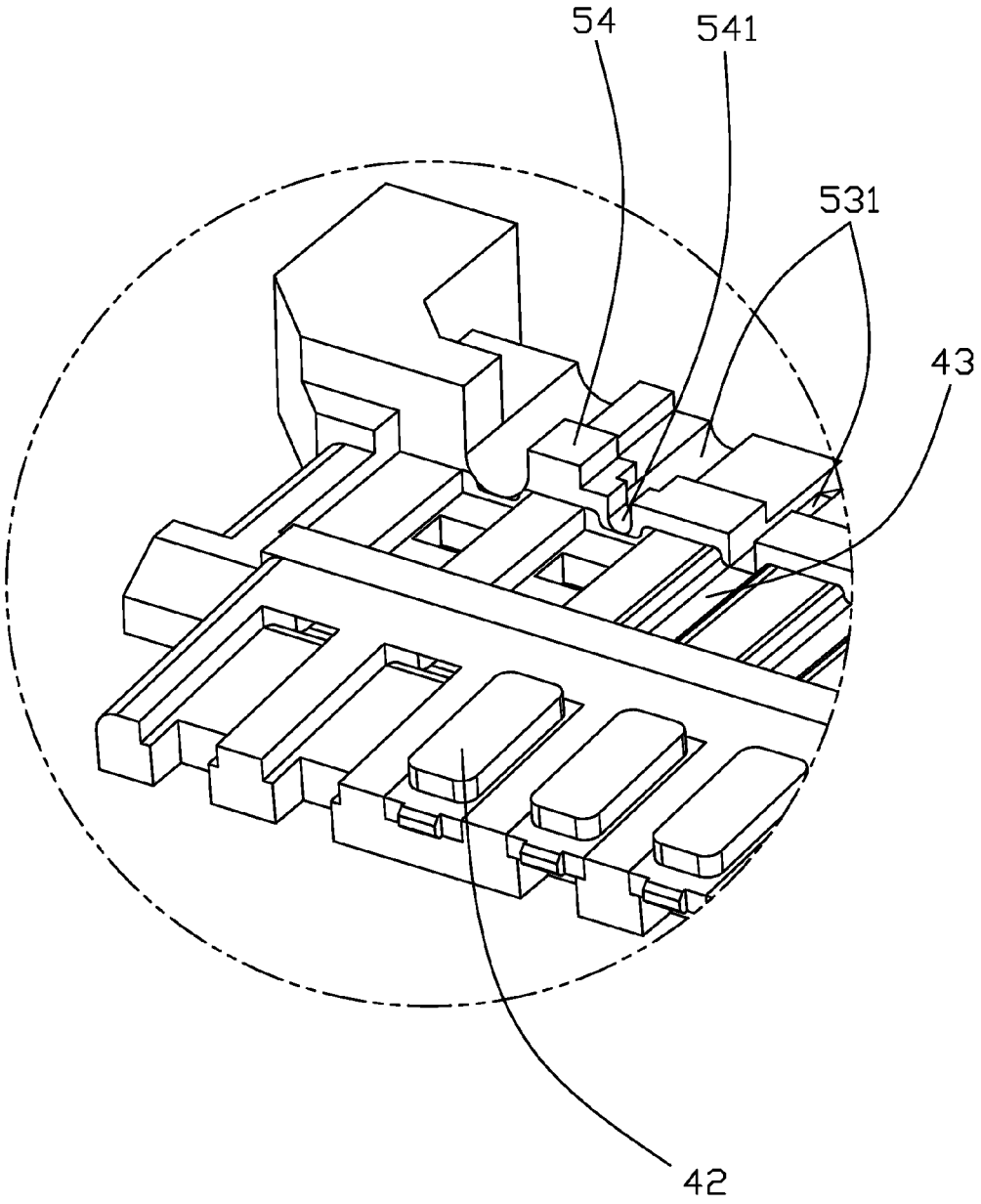
FIG. 8 is an enlarged partial perspective view of the upper terminal module of the electrical cable connector of FIG. 6.

Reference will now be made in detail to the embodiments of the present disclosure. Referring to FIGS. 1-12, an electrical cable connector 100 includes an insulative base 3, a plurality of terminals 4 and a plurality of wires 1 connected to the corresponding terminals 4. The base 3 includes a main body 32 and a mating tongue 31 forwardly extending from the main body 32. The mating tongue 31 includes opposite mating faces 301. The terminal 4 includes a front contacting section 42 a rear connecting section 43. The contacting section 42 is exposed upon the mating face 301. The terminals 4 are integrally formed within a contact module 2 which includes an upper terminal module 2*a* and a lower terminal module 2*b* commonly sandwiching a metallic shielding plate 6 wherein the base 3. is applied upon the assembled contact module 2 via an overmolding process.

The upper terminal module 2*a* and the lower terminal module 2*b* are similar to each other in a symmetrical arrangement in the vertical direction with the corresponding wires 1*a* and 1*b* respectively connected thereto.

The terminal 4 includes a plate 41 composed of in a front-to-back direction a front plate 411 and the rear plate 412 with an offset therebetween. The front plate 411 forms the contacting section 42 thereon for mating with a complementary connector while the rear plate 412 forms a longitudinal recess 431 to form the connecting section 43 for soldering to the corresponding wire 1. The contacting section 42 is exposed upon and flush with the mating surface 301. An alternate embodiment shown in FIG. 10, discloses the terminal forms a through recess 432 in the vertical direction. The terminals include the grounding terminals 4G, the power terminals and the signal terminals. In this embodiment, the grounding terminals G and the paired signal terminals are alternately arranged with each other in the transverse direction perpendicular to the vertical direction and the front-to-back direction.

The upper terminal module 2*a*, as well as the lower terminal module 2*b*, includes an insulator 5 integrally formed with the corresponding terminals 4, the grounding bar 7 and the pressing block 8. The insulator 5 has the first section 51, the second section 52 and the third section 53. The front plate 411 of the terminal 4 including the contacting section 42 is embedded within the first section 51 wherein the contacting section 42 is exposed the exterior surface of the first section 51. The rear plate 412 with the connecting section 43 is embedded within the second section 52 wherein the connecting section 43 is exposed upon the exterior surface of the second section 52. The third section 53 forms a plurality of passageways 531 in alignment with the corresponding connecting sections 43, respectively, along the front-to-back direction, to receive the corresponding wires 1. An abutment section 54 is formed between the second section 52 and the third section 53 and forms a notch 541 in alignment with the corresponding passageway 531 so as to allow the inner conductor of the corresponding wire 1 to extend therethrough and soldered upon the corresponding connecting section 43.

The wires 1 includes a plurality of signal wires 11 and a plurality of power wires 12. The signal wire 11 is a co-axial wire while the power wire 12 has a single inner conductor. In this embodiment, the wires 11 arranged in one row, have two power wires 12 at two opposite ends and the signal wires 11 therebewteen. The signal wire 11 includes a conductor 111, an inner insulator 112 surrounding the conductor 111, a metallic braiding layer 113 surrounding the inner insulator 112, and an outer insulator 114 surrounding the braiding layer 113. Front end sections of the conductor 111, the inner insulator 112, the braiding layer 113 and the outer insulator 114 are respectively exposed to an exterior in sequence. The power wire 12 includes a conductor 121 and an insulator 122 surrounding the conductor 121. The power wires 12 are connected to the power terminals of the terminal module, and the signal wires 11 are connected to the signal terminals of the terminal module. The grounding terminals 4G are commonly grounded by the grounding bar 7.

The grounding bar 7 includes a main body 71, a plurality of first arms 72 extending forwardly from the main body 71, and a plurality of second arms 73 extending rearwardly from the main body 71 and aligned with the corresponding first arms 72 in the front-to-back direction, respectively. The grounding bar 7 is located between the wires 71 and the shielding plate 6, and the braiding layers 113 of the wires 1 are soldered upon the main body 71. The first arms 72 extend forwardly and is terminated at a position similar to the conductor 111, and positioned upon the connecting sections 43, respectively. The second arms 73 are exposed outside of the contact module 2.

The wires 1 and the grounding bar 7 are firstly assembled to the corresponding insulator 5, and the pressing block 8 is assembled successively. The pressing block 8 is made of insulative material and assembled upon the third section 53 to cooperate with the third section 53 to sandwich the wires 1 therebetween. The pressing block 8 includes the receiving slots 81, 82 corresponding to the passageways 531 to receive the corresponding wires 1 and the first arms 72. Notably, the passageways 531 and the corresponding receiving slots 81 both of which receive the corresponding wires 1, are configured to be semi-circular while those for receiving the corresponding first contact 72 are configured to be rectangular.

The shielding plate 6 includes a plurality of front spring fingers 61 and a plurality of rear spring fingers 62 aligned with each other in a front-to-back direction while extending in opposite direction away from each other. The front spring finger 61 and the corresponding spring finger 62 extend oppositely in the vertical direction. The front spring finger 61*a* and the neighboring front spring fingers 61*b* extend oppositely in the vertical direction, and the rear spring fingers 62*a* and the neighboring rear spring fingers 62*b* extend in the same pattern. The shielding plate 6 has two rows of rectangular windows 63, and a linking section 64 is located between each paired windows 63. The front spring fingers 61 and the rear spring fingers 62 respectively extend from opposite edges of the corresponding linking section 64 toward the corresponding windows 63. The front spring finger 61 connects to the contacting section 42 and the rear spring finger 62 connects to the connecting section, respectively. The first section 51 of the insulator 5 forms a plurality of openings 511 respectively vertically aligned with the contacting sections 42, and the second section 52 of the insulator 5 forms a plurality of openings 521 respectively vertically aligned with the connecting sections 43 so as to allow the front spring fingers 61 to extend through the openings 511 to contact the corresponding contacting sections 42 of the grounding terminals 4G, and the rear spring fingers 62 to extend through the opening 521 to contact the corresponding connecting sections 43 of the grounding terminals 4G. At the same time, the second arms 73 are connected to the shielding plate 6 to form a path, thus reducing the EMI (Electro-Magnetic Interference). The shielding plate 6 extends out of the mating tongue 31 and divides the mating tongue 31 into two opposite parts symmetrically. The terminals 4 are aligned with the wires 1 and the first arms 72 of the grounding bar 7 in the front-to-back direction.

The insulator 5 further includes mounting posts 55 and the mounting holes 56, and the shielding plate 6 forms through holes 65 in alignment with the corresponding mounting posts 55 so as to have the mounting post 55 of the upper terminal module 2*a* extend through the corresponding through hole 65 into the mounting hole 56 of the lower terminal module 2*b*, and vice versa, for combining all the upper terminal module 2*a*, the lower terminal module 2*b* and the shielding plate 6 therebetween as an intermediate sub-assembly wherein each terminal module 2*a*, 2*b* is equipped with the corresponding grounding bar 7 and pressing block 8. After then, an outer insulator is applied upon the sub-assembly to enclose the front end region and the rear region of the sub-assembly to form the base 3 for completeness of the whole connector.

The method of making the instant connector includes steps as follows: (1) providing the upper terminal module 2*a* and the lower terminal module 2*b* each including an insulator 5 with a one row of terminals 4 via an insert-molding process wherein each terminal 4 includes a front contacting section 42 and a rear connecting section 43 both exposed upon a surface of the insulator 5; (2) providing two rows of wires each including signal wires 11 and power wires 12; (3) providing two grounding bars 7 each located outside of the corresponding insulator 5 and vertically inside the corresponding wires 1 with the braiding layer 113 of the corresponding signal wires 11 soldered thereon; (4) assembling the wires 1 with the associated grounding bar 7 into the corresponding terminal module 2*a*, 2*b* wherein the inner conductor 111 of the signal wires re connected to the connecting sections 43 of the terminals 2 while the first arms 72 of the grounding bar 7 are connected to the connecting sections 43 of the grounding terminals 4G; (5) providing a metallic shielding plate 6 sandwiched between the upper terminal module 21 and the lower terminal module 2*b* to form a sub-assembly with the second arms 72 of the corresponding grounding bar 7 pressing the shielding plate 6; (6) applying an insulative material upon an exterior of such a sub-assembly via an over-molding process to further cover front ends of the wires 1 so as to form the base 3 with the mating tongue 32 for finalizing the contour of the connector 100 wherein the contacting sections 42 of the terminals 4 are exposed upon the mating faces 301 of the mating tongue 32 while the connecting sections 43 and the conductor 111 of the wires are embedded within the insulative base 3.

Figure 9:
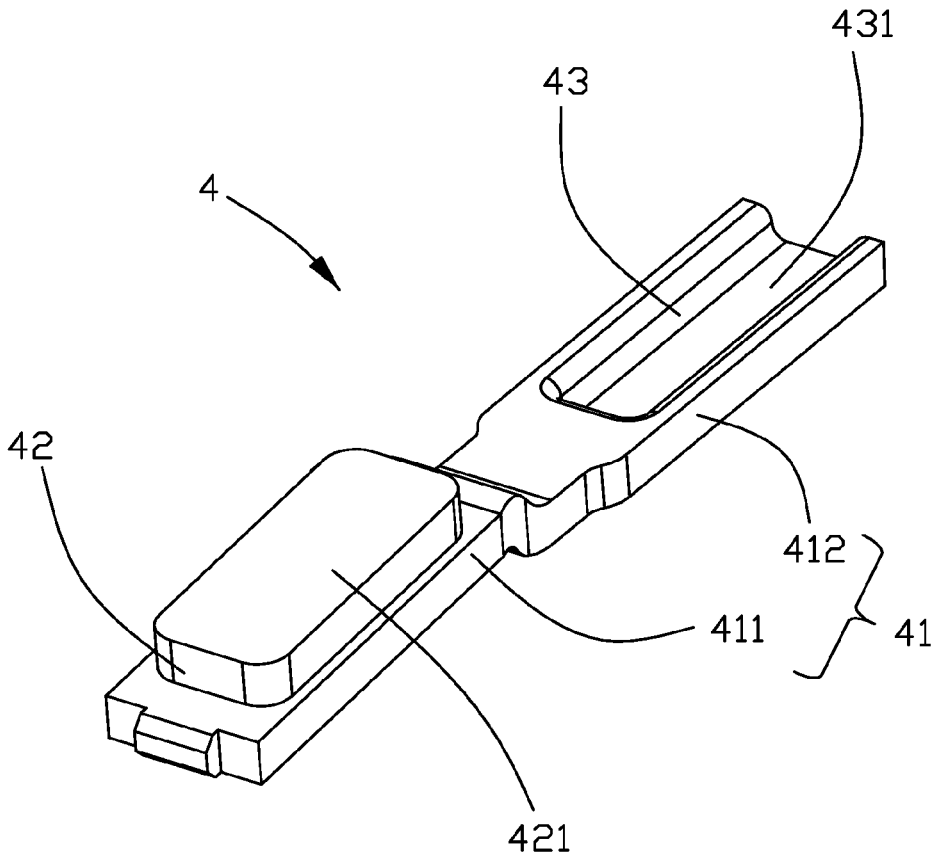
FIG. 9 is a perspective view of the terminal of the contact module of the electrical cable connector of FIG. 6.
Figure 10:
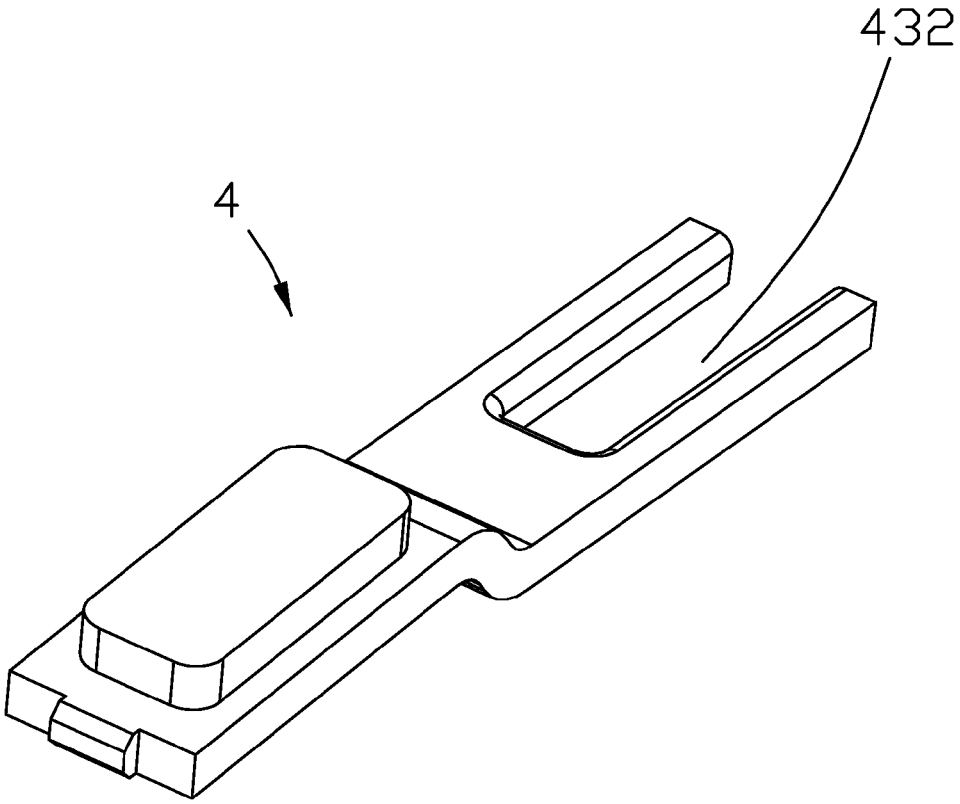
FIG. 10 is a perspective of the terminals of the contact module of the electrical cable connector according to another embodiment.
Figure 11:
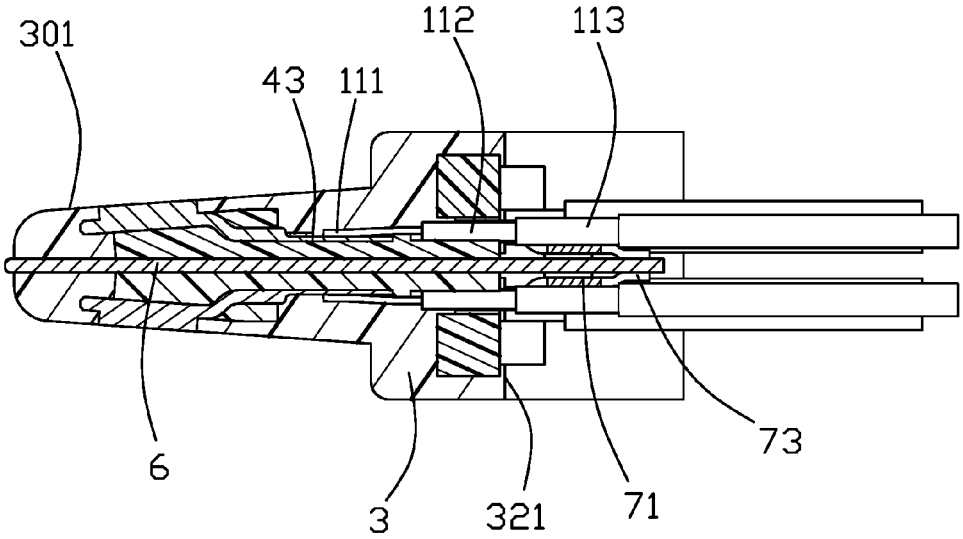
FIG. 11 is a cross-sectional view of the electrical cable connector of FIG. 1.

In this embodiment, the wires 1 are firstly connected to the corresponding connecting sections 43 and successively applied with an insulative material thereon to form the insulative base 3, Under this situation, for the wire 11, the front end portion of the conductor 111 is exposed in front of the inner insulator 112, retained in the notch 541, further soldered upon the connecting section 43 and successively protectively covered by the insulative base 3; the inner insulator 112 located behind the exposed conductor 111, is retained in the passageway 531 and the corresponding receiving slot 81; the braiding layer 113 is located behind the rear end face 321 of the base 3 and connected/soldered to the main body 71 of the grounding bar 7; the shielding plate 6 rearwardly extends beyond the rear end face 321 with the second arms 73 of the grounding bar 7 connected thereto. The front spring fingers 61 and the rear spring fingers 62 are respectively connected the corresponding terminals 4 in the upper and lower rows wherein the front spring finger 61 connects to the front plate 411 and the rear spring finger 62 connects to the rear plate 412, In this embodiment, the conductor 111 of the wire 1 or the first arm 72 of the grounding bar 7 is connected upon an outer surface of the corresponding connecting section 43 while the rear spring finger 62 of the shielding plate 6 is connected to an inner surface of the corresponding connecting section 43. Notably, on one hand the shielding plate 6, the grounding bar 7, the braiding layers 113 of the signal wires 11, and the grounding terminals 4G all are grounded together in a robust manner, thus not only lowering EMI (Electron-Magnetic Interference) but also reducing the dimension of the whole connector. It should be noted that in FIG. 10, the recess 431 as shown in FIG. 9 is converted into the through slot 432 so as to have the corresponding conductor 111 soldered therein in a low profile manner compared with the recess 431 disclosed in FIG. 9. On the other hand, the insulator 5, the shielding plate 6, the pressing block 8, the grounding bar 7 and even the insulative base 3 mechanically interact with one another so as to have the wires 1 efficiently retained in position in a robust manner too. In this embodiment, the shielding plate 6 rearwardly extends beyond the exposed braiding layer 113 so as to have the second arms 73 soldered upon the shielding plate 6 and located behind the exposed braiding layer 113.

Figure 12:
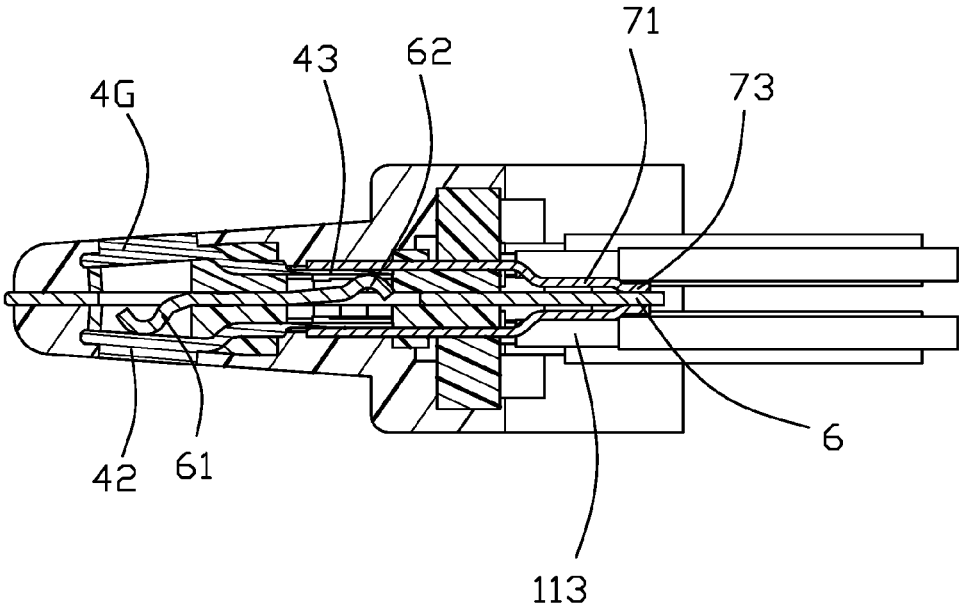
FIG. 12 is another cross-sectional view of the electrical cable connector of FIG. 1.
Figure 13:
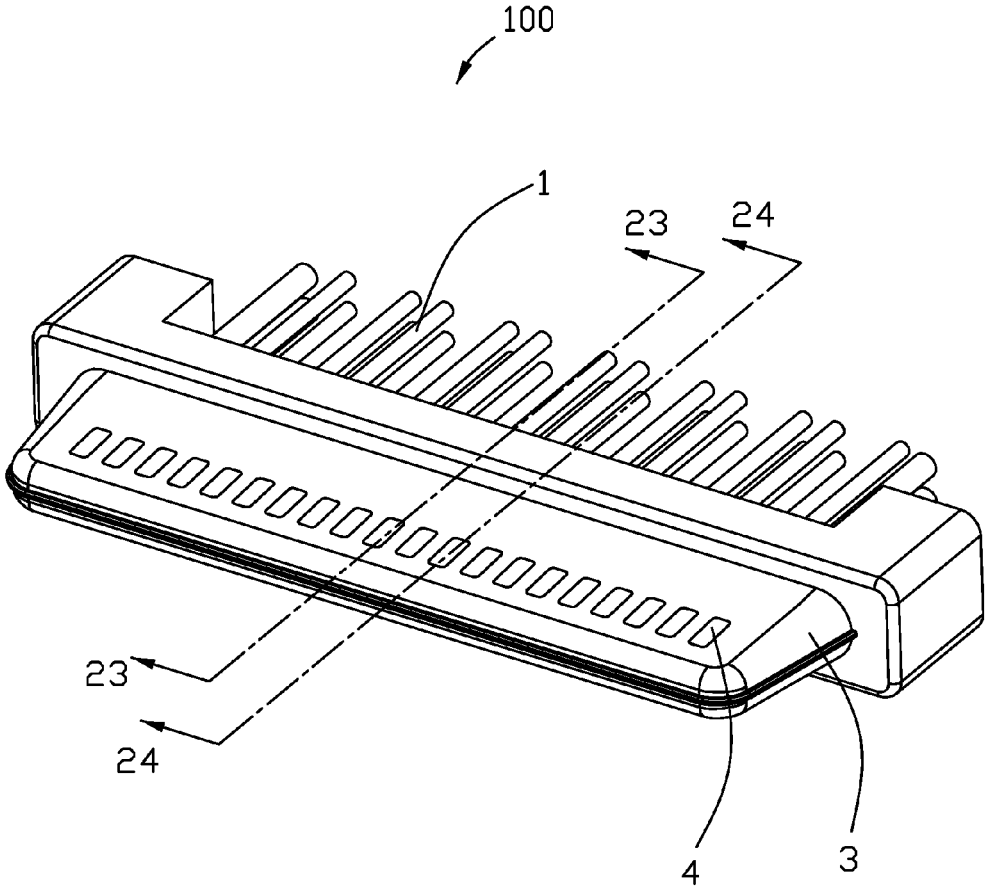
FIG. 13 is a perspective view of an electrical cable connector of the invention according to the second embodiment.
Figure 14:
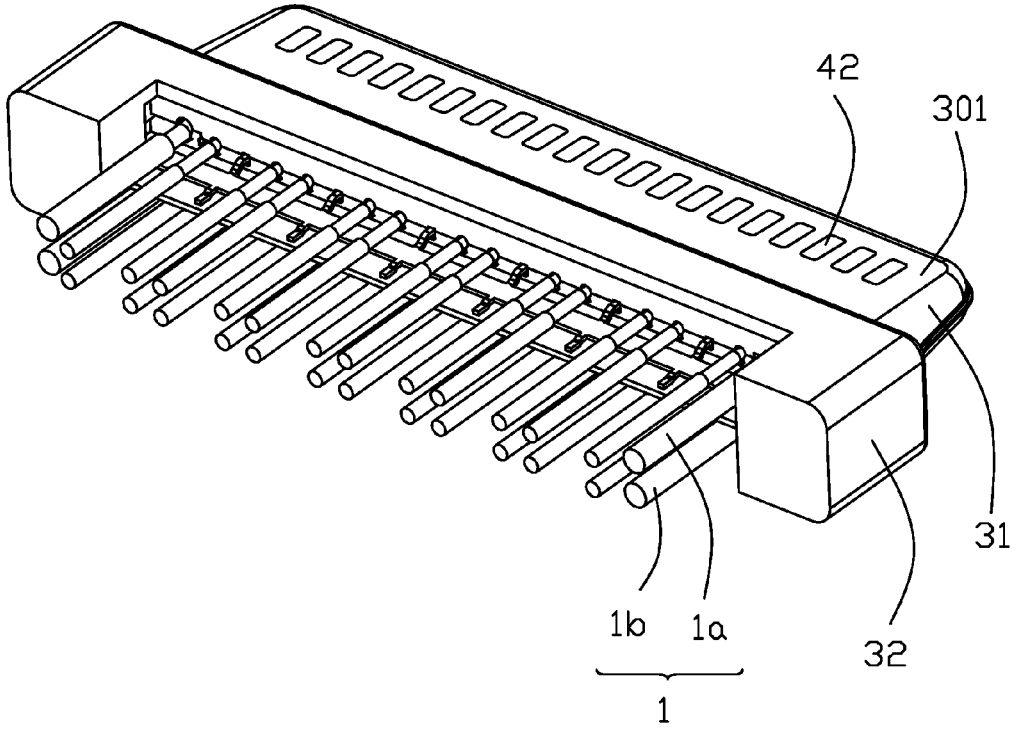
FIG. 14 is another perspective view of the electrical cable connector of FIG. 13.
Figure 15:
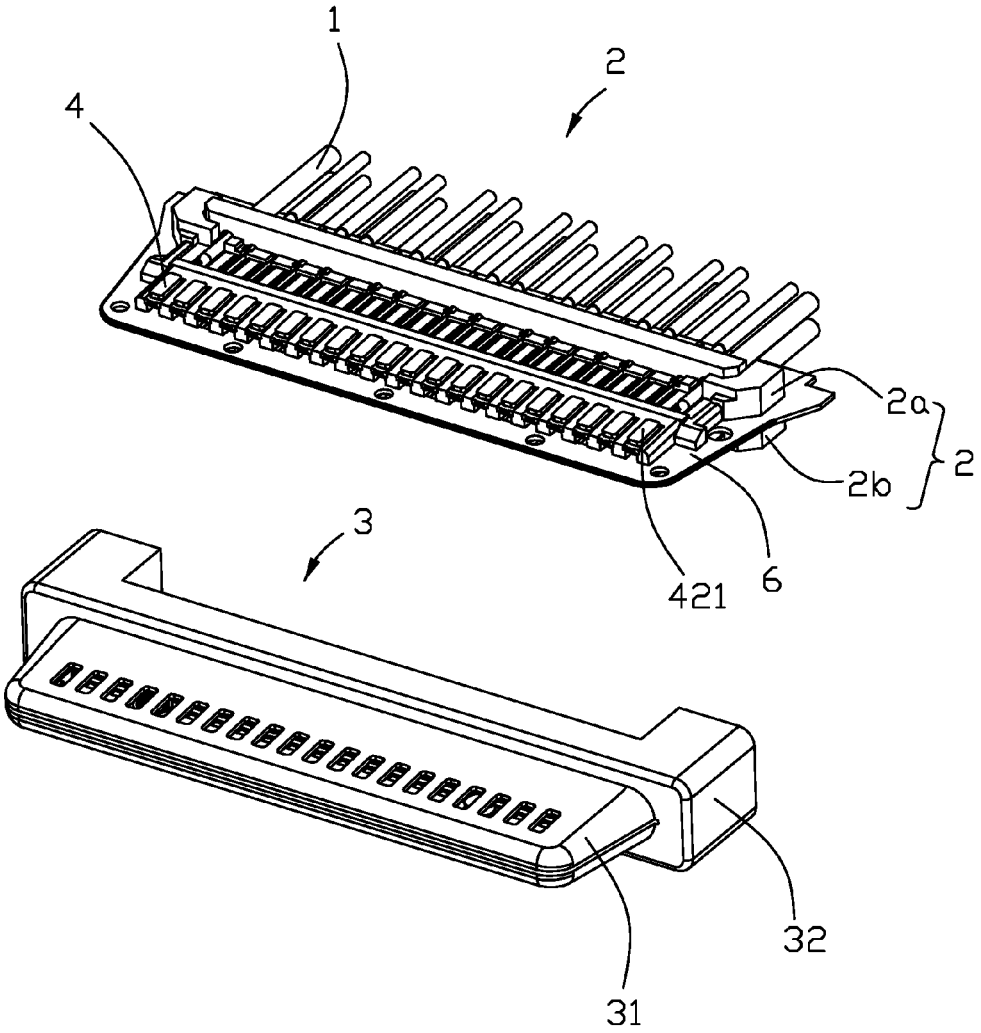
FIG. 15 is an exploded perspective view of the electrical cable connector of FIG. 1.
Figure 16:
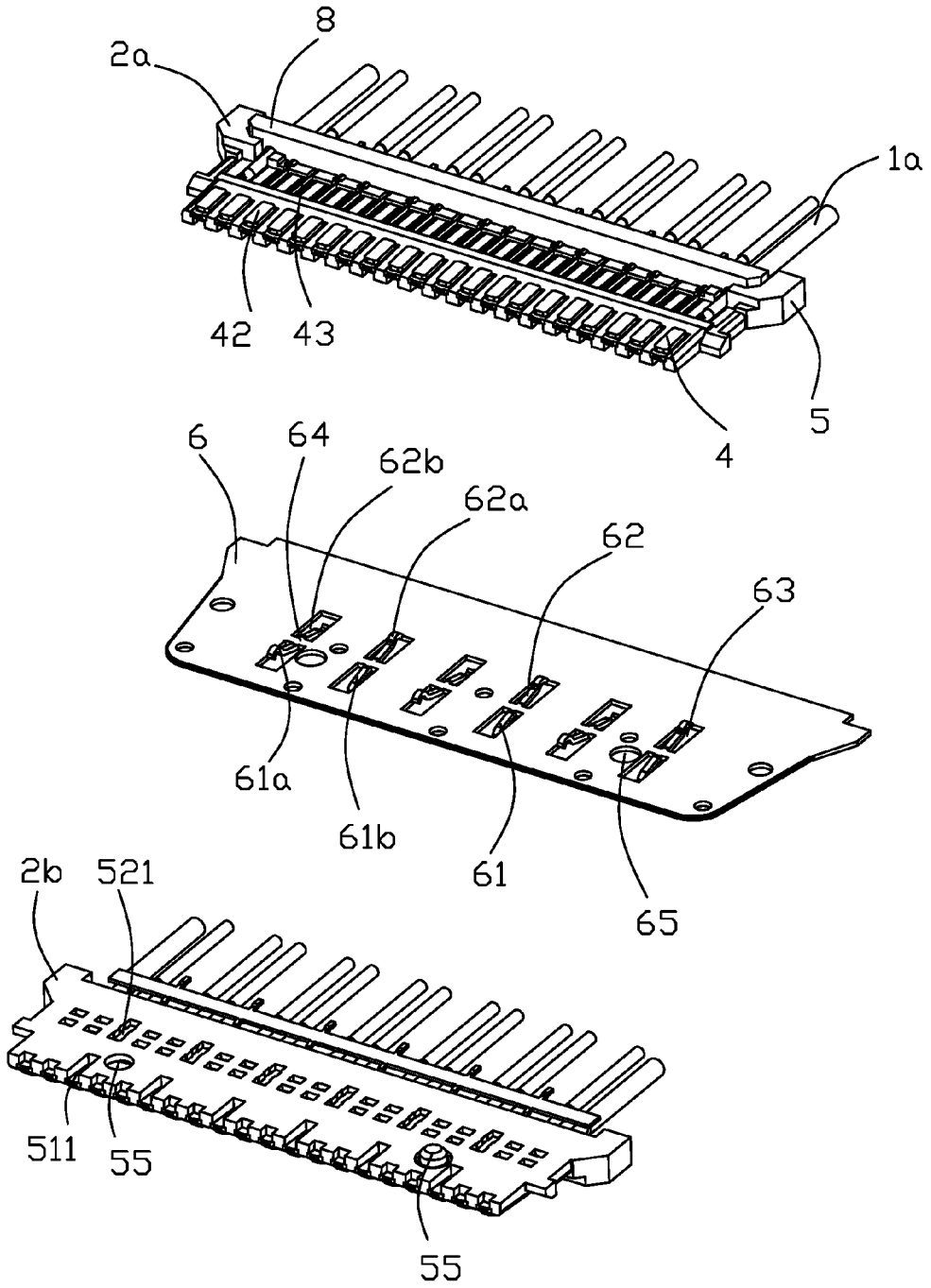
FIG. 16 is a further exploded perspective view of the contact module of the electrical cable connector of FIG. 15.
Figure 17:
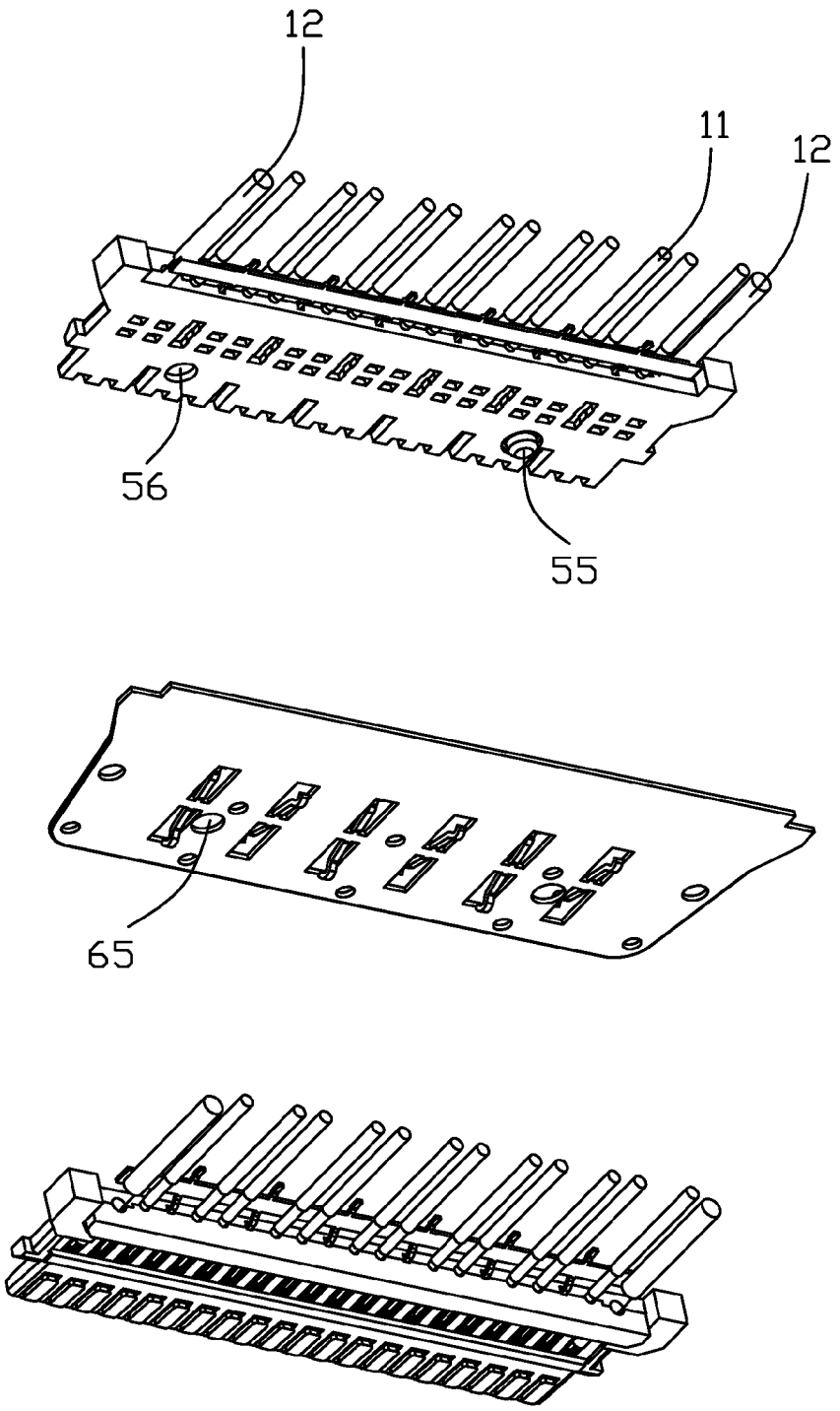
FIG. 17 is another exploded perspective view of the contact module of the electrical cable connector of FIG. 16.
Figure 18:
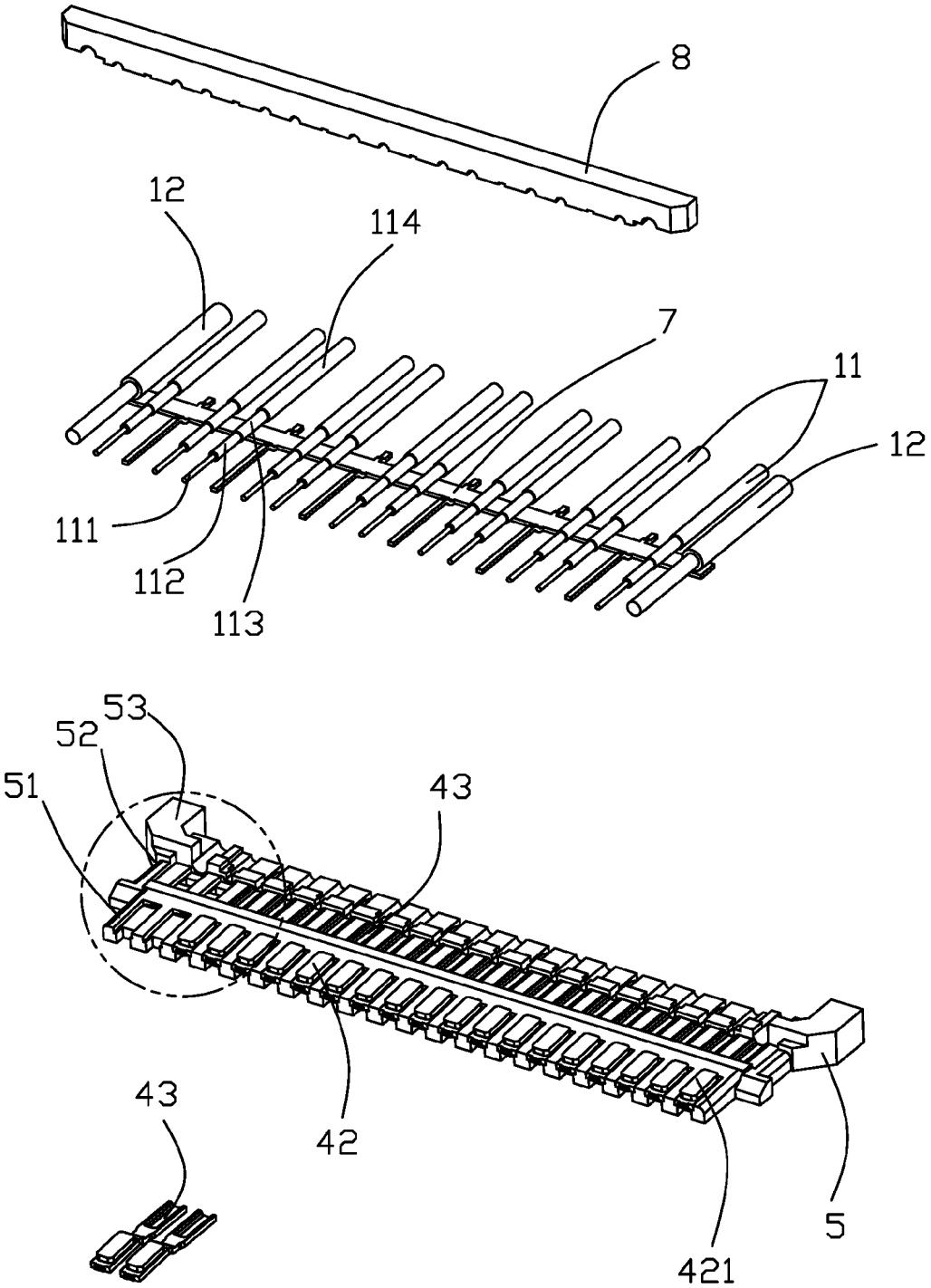
FIG. 18 is an further exploded perspective view of the upper terminal module of the contact module of the electrical cable connector of FIG. 16.
Figure 19:
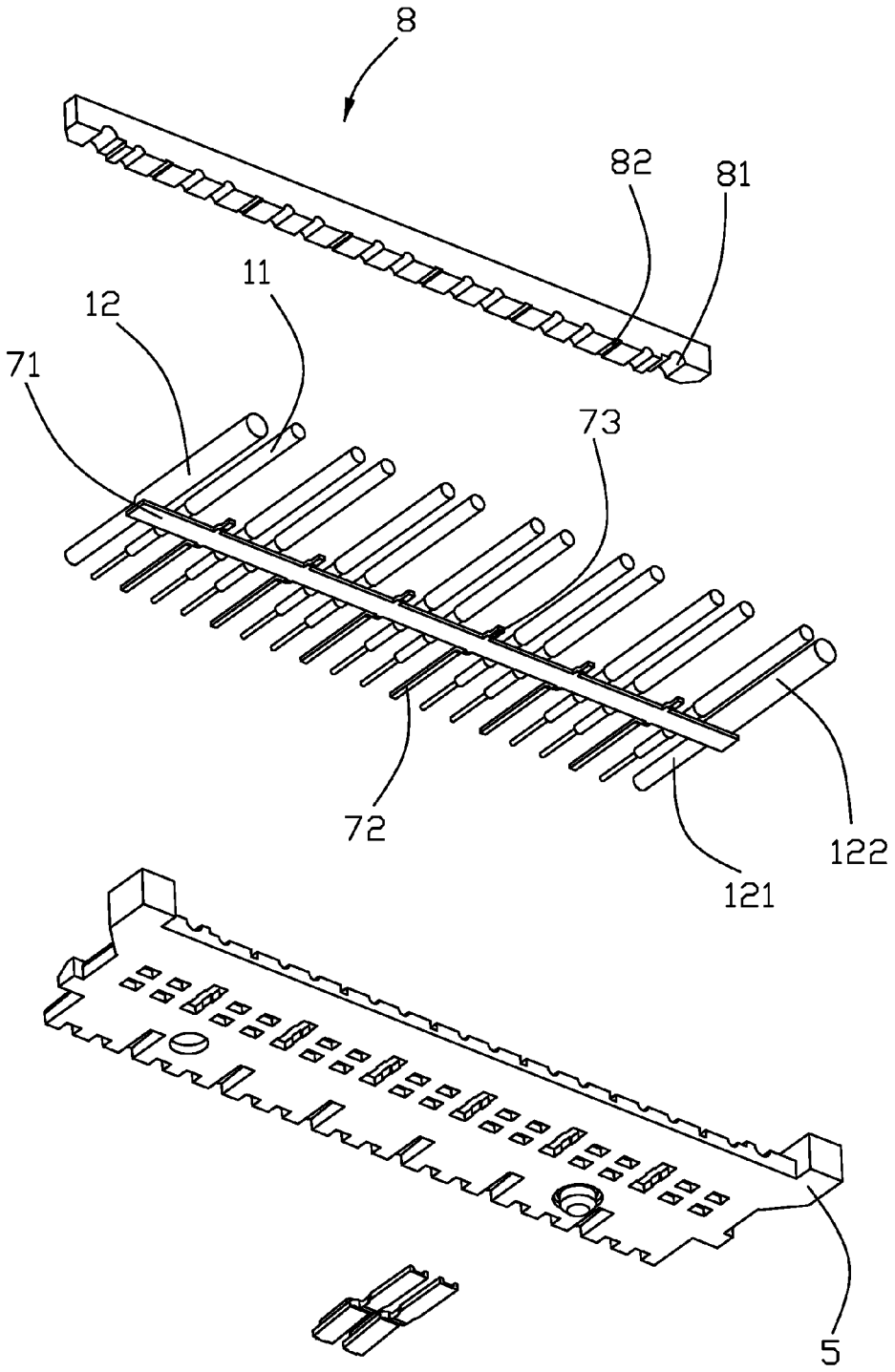
FIG. 19 is another perspective view of the upper terminal module of the contact module of the electrical cable connector of FIG. 18.
Figure 20:
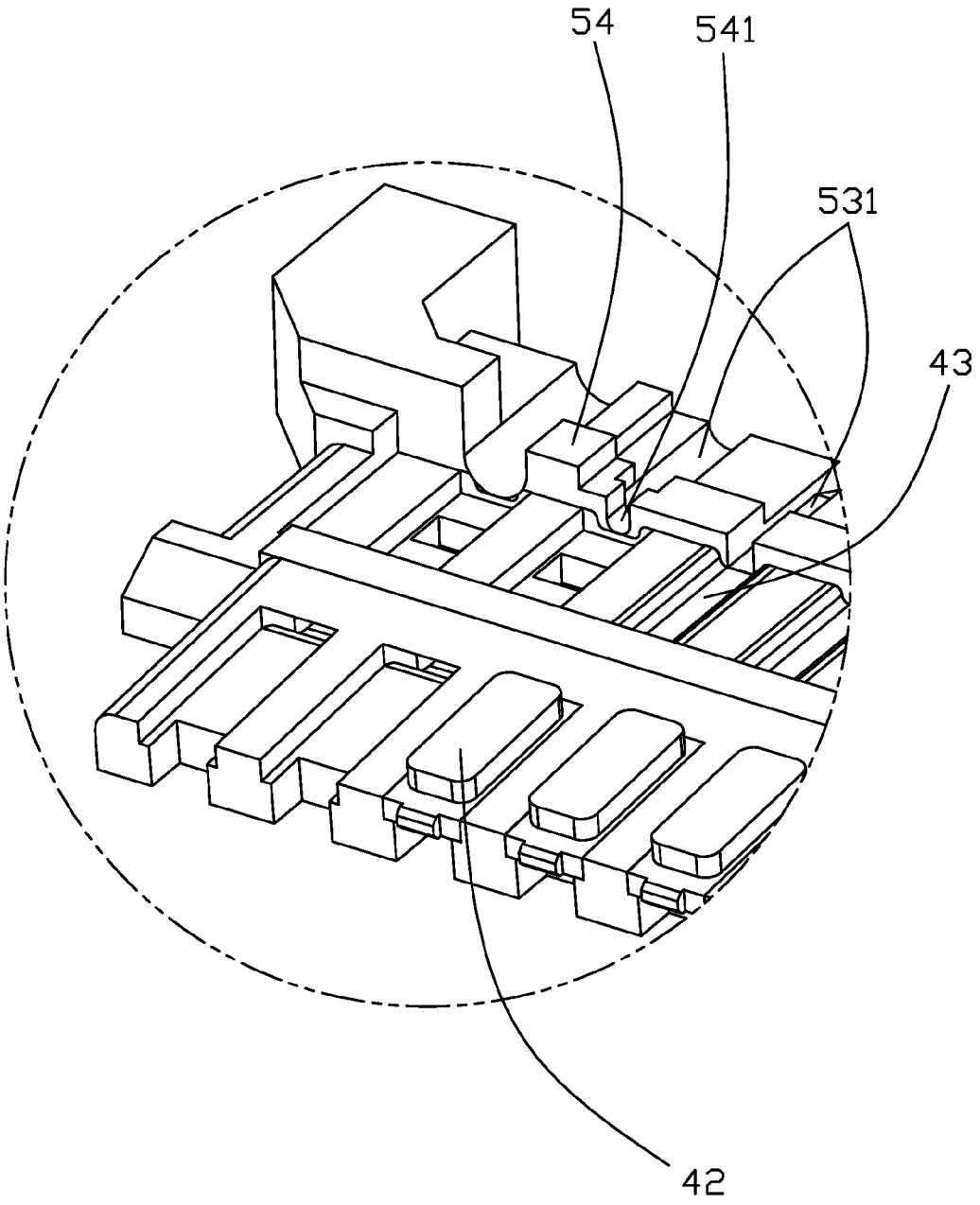
FIG. 20 is an enlarged partial perspective view of the upper terminal module of the electrical cable connector of FIG. 18.
Figure 21:
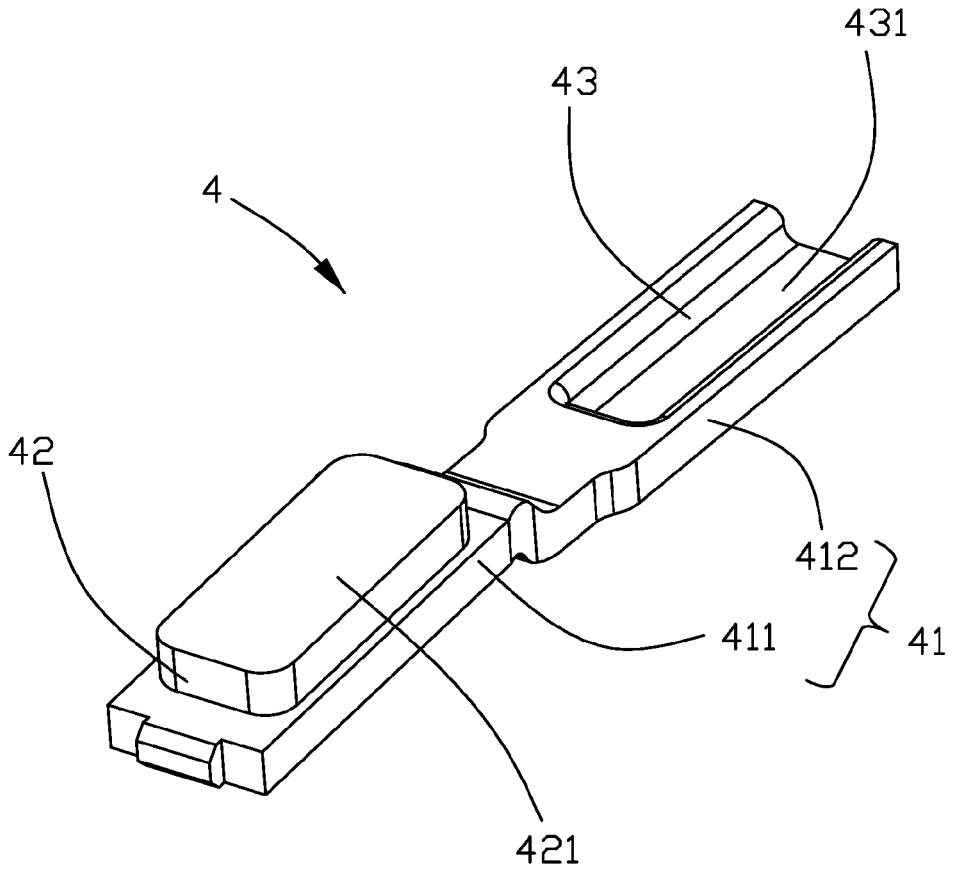
FIG. 21 is a perspective view of the terminal of the contact module of the electrical cable connector of FIG. 18.
Figure 22:
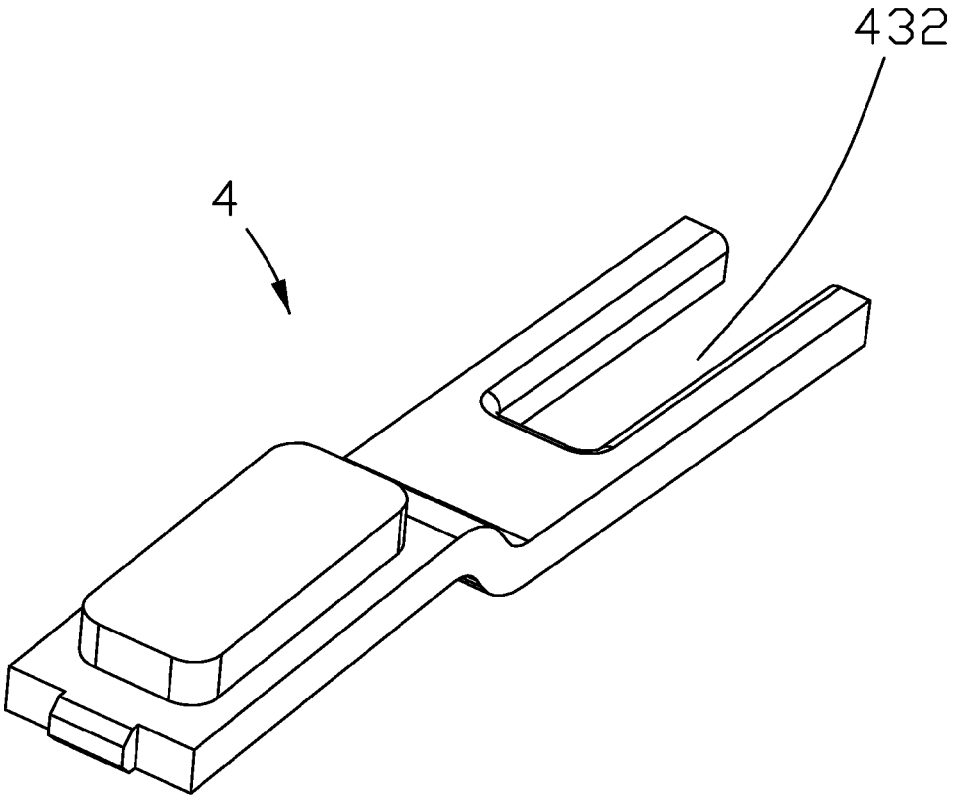
FIG. 22 is a perspective of the terminals of the contact module of the electrical cable connector according to another embodiment.
Figure 23:
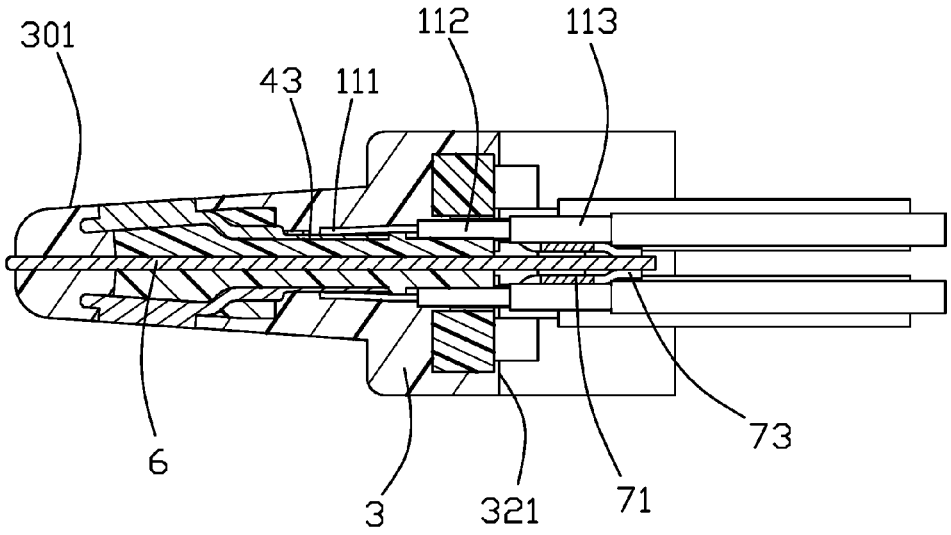
FIG. 23 is a cross-sectional view of the electrical cable connector of FIG. 13.
Figure 24:
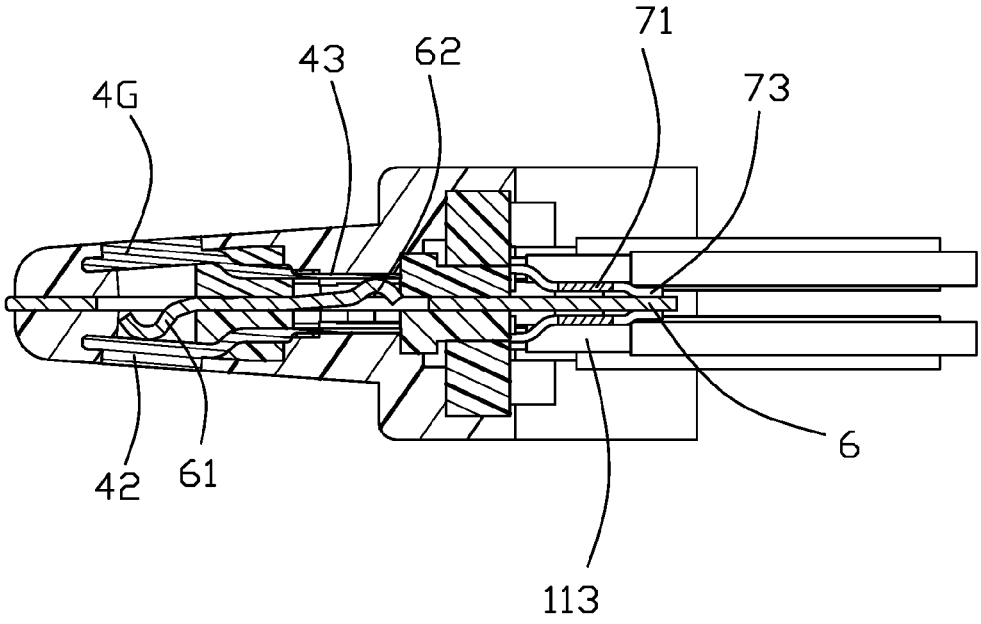
FIG. 24 is another cross-sectional view of the electrical cable connector of FIG. 13.
Figure 25:
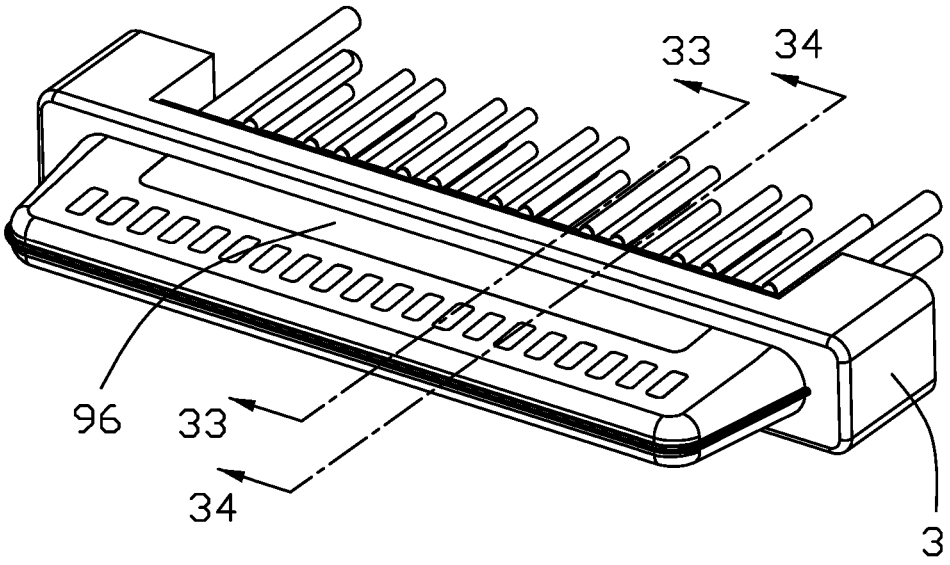
FIG. 25 is a perspective view of an electrical cable connector of the invention according to another embodiment.
Figure 26:
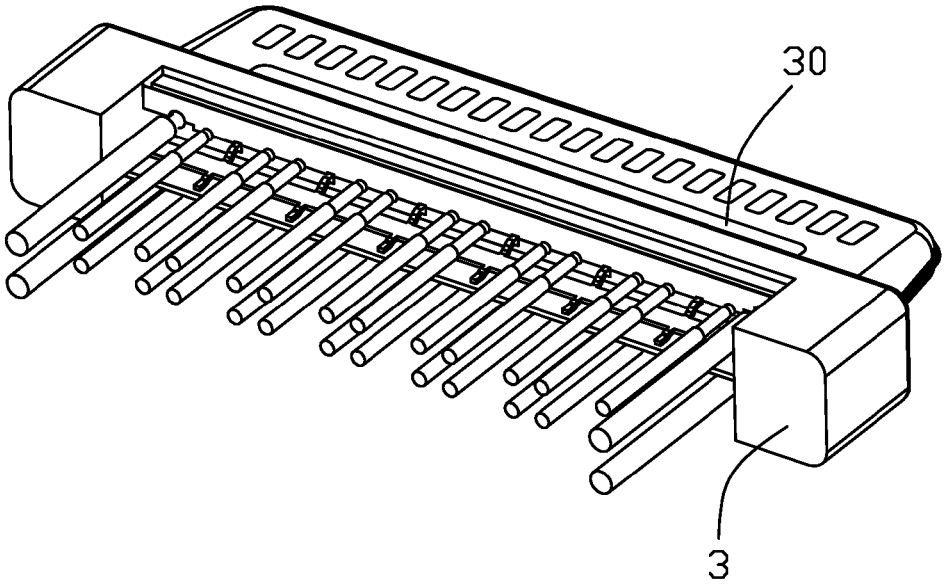
FIG. 26 is another perspective view of the electrical cable connector of FIG. 25.
Figure 27:
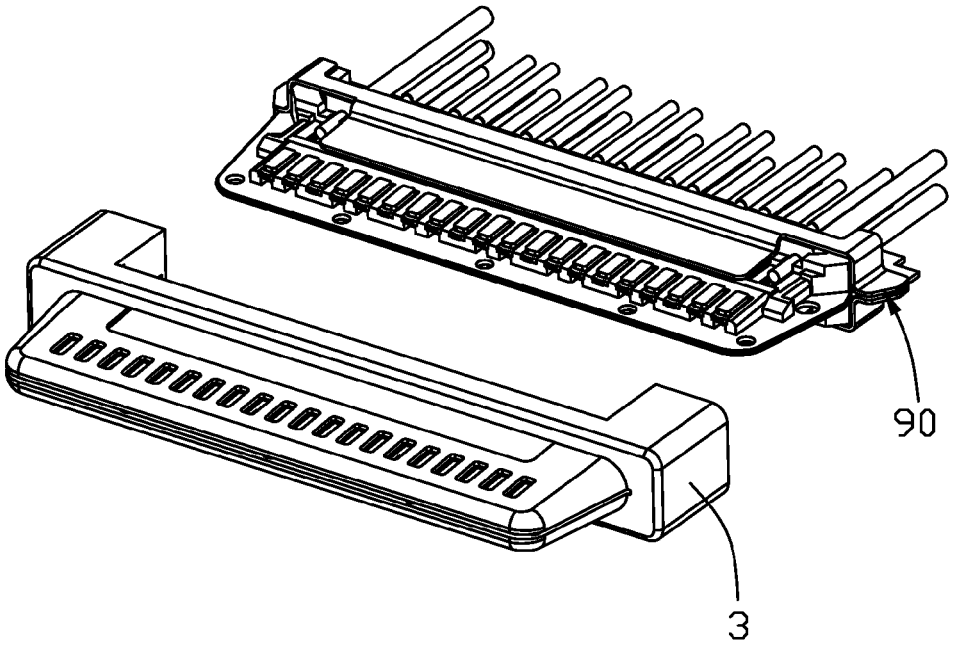
FIG. 27 is an exploded perspective view of the electrical cable connector of FIG. 25.
Figure 28:
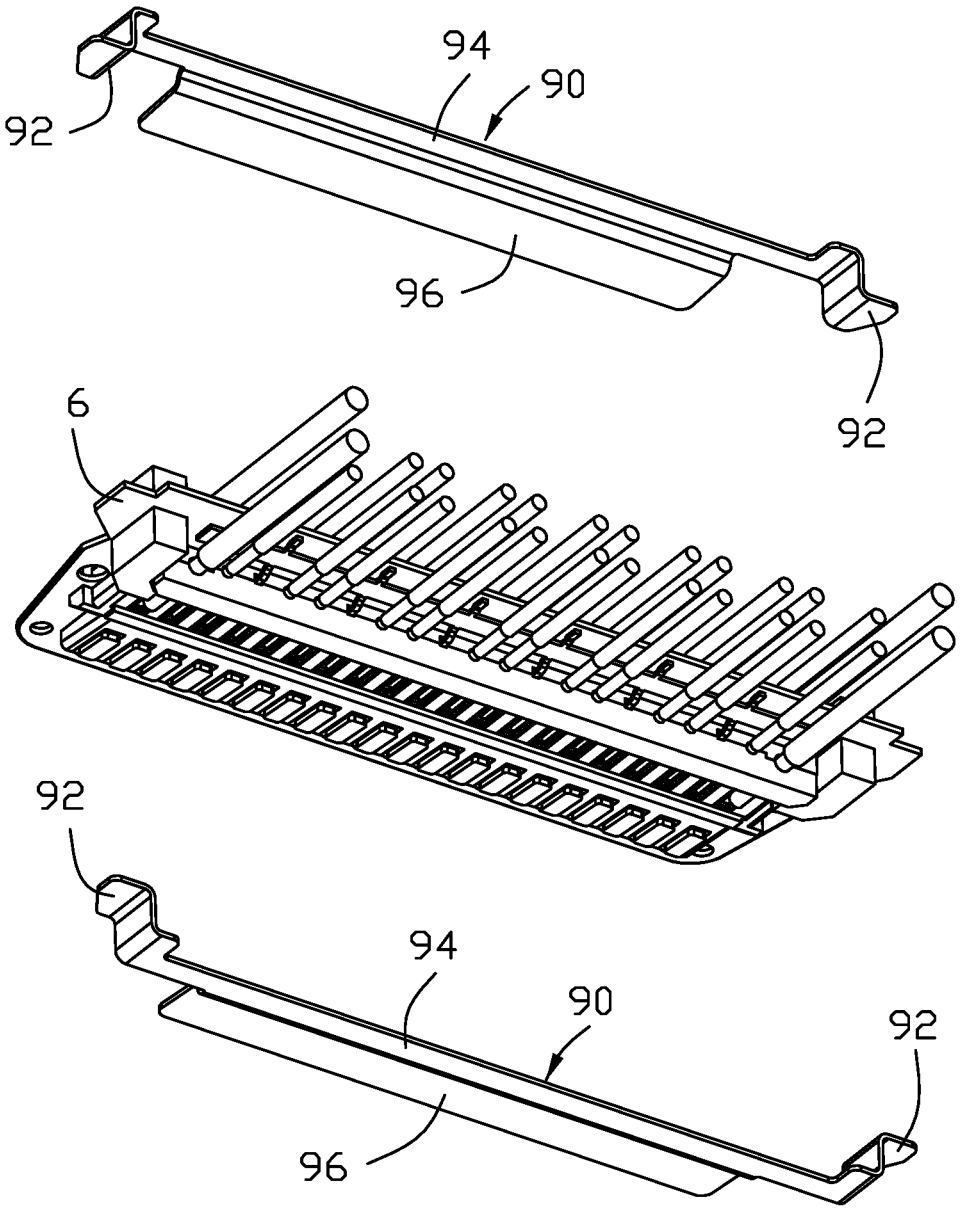
FIG. 28 is a further exploded perspective view of the contact module of the electrical cable connector of FIG. 27.
Figure 29:
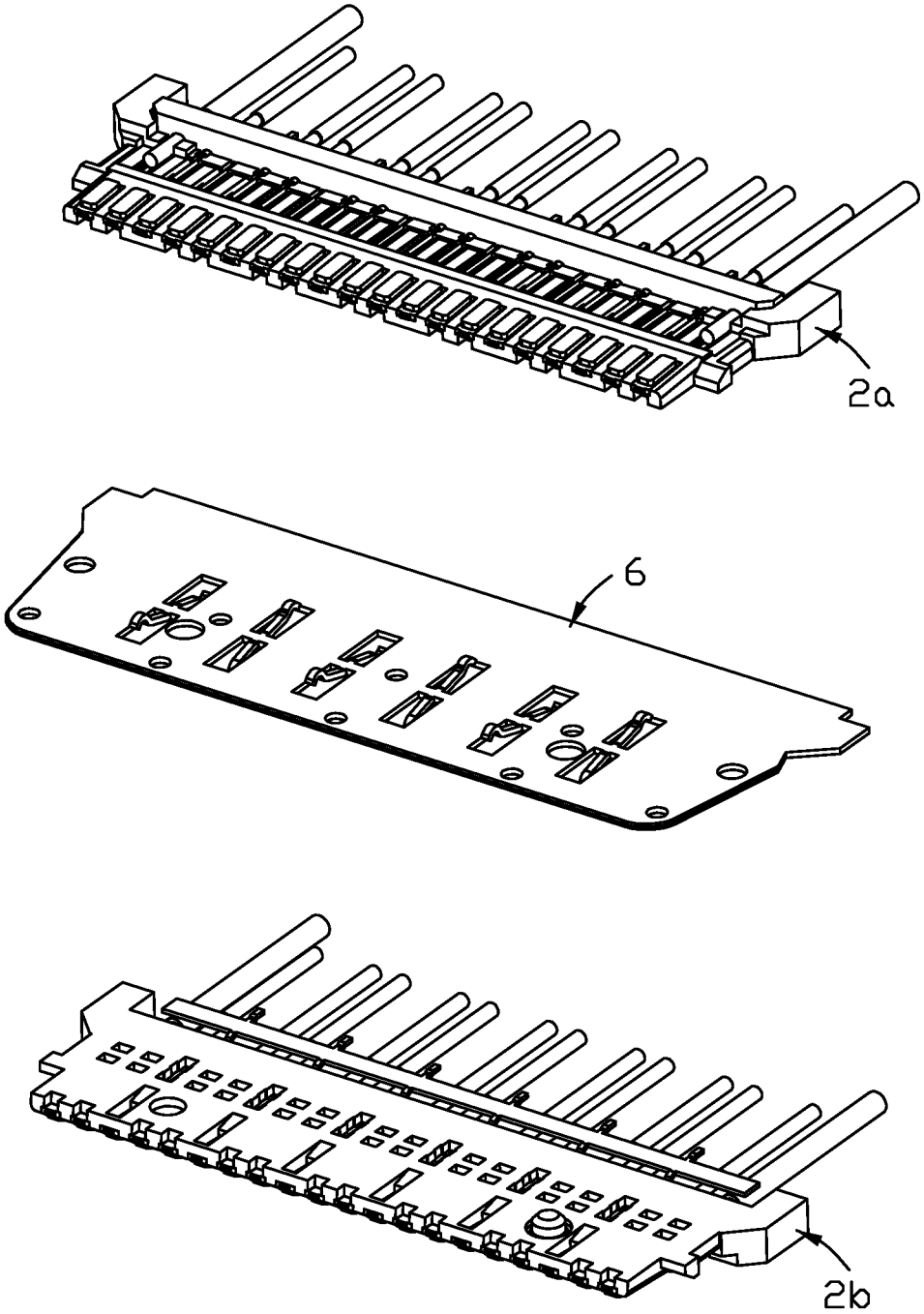
FIG. 29 is a further exploded perspective view of the contact module of the electrical cable connector of FIG. 28.
Figure 30:
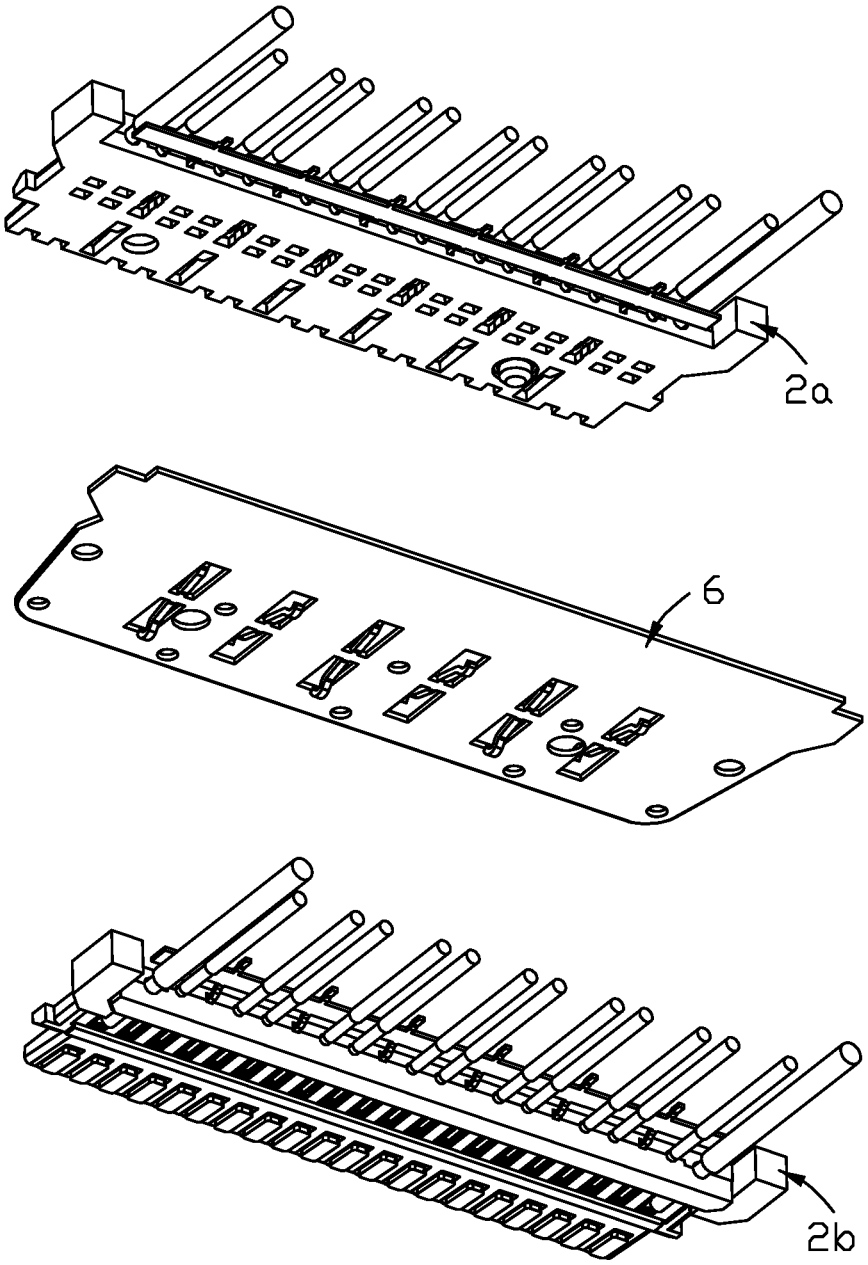
FIG. 30 is another exploded perspective view of the contact module of the electrical cable connector of FIG. 29.
Figure 31:
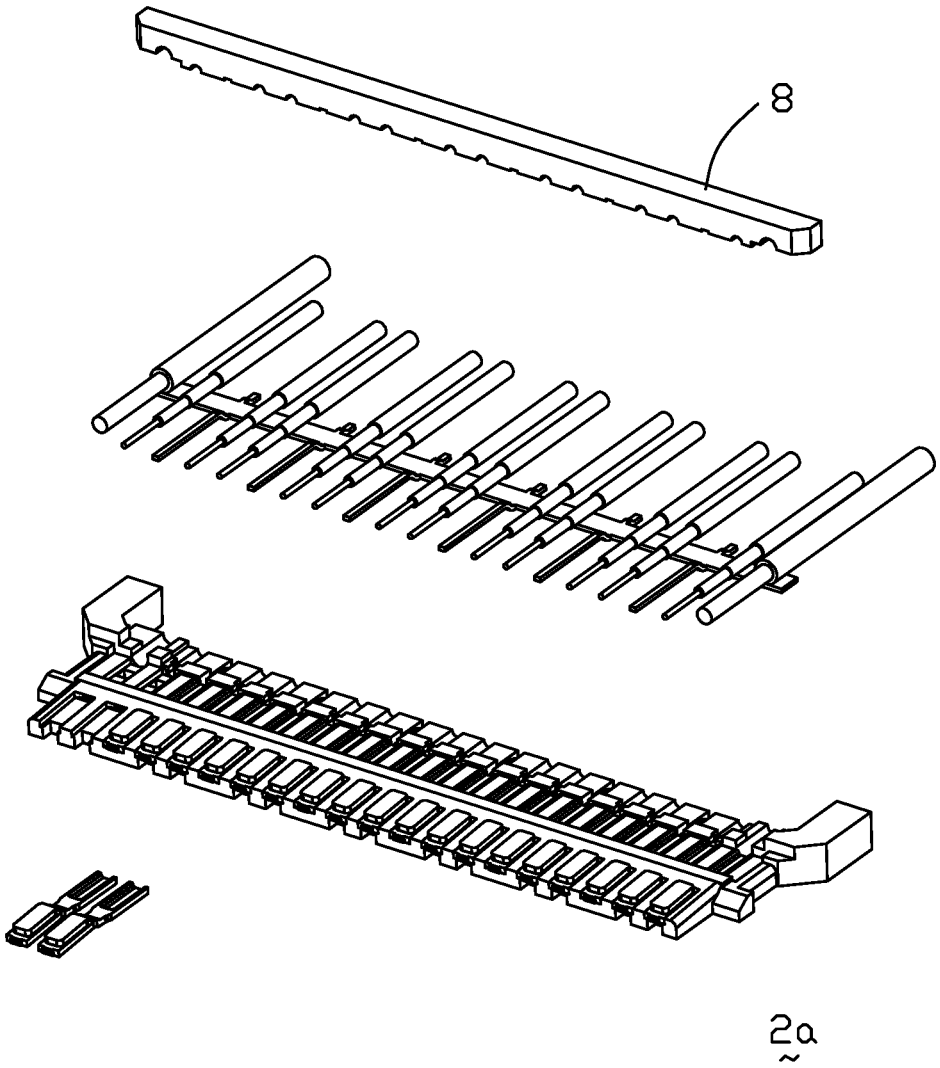
FIG. 31 is a further exploded perspective view of the upper terminal module of the contact module of the electrical cable connector of FIG. 30.
Figure 32:
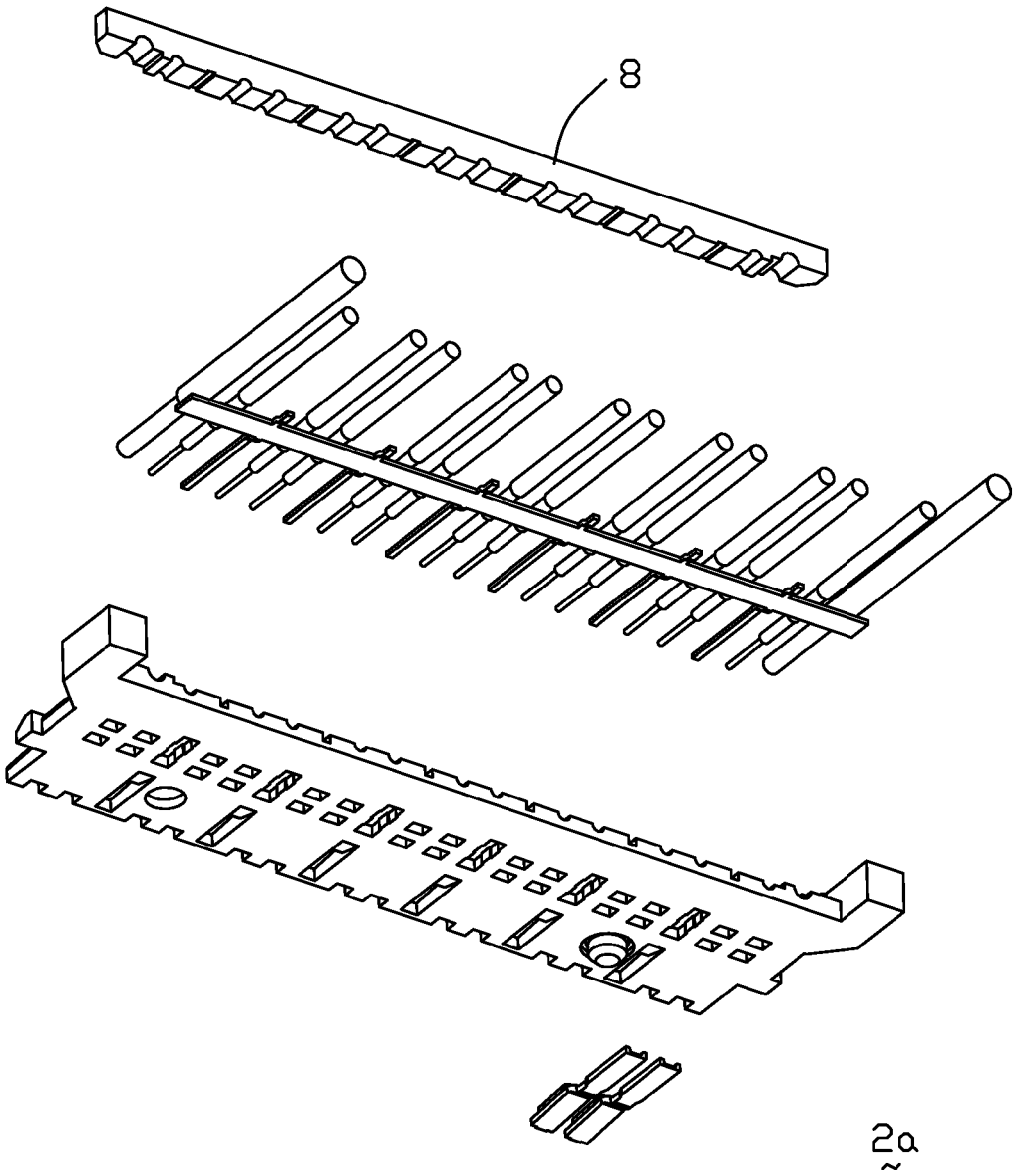
FIG. 32 is another exploded perspective view of the upper terminal module of the contact module of the electrical cable connector of FIG. 31.
Figure 33:
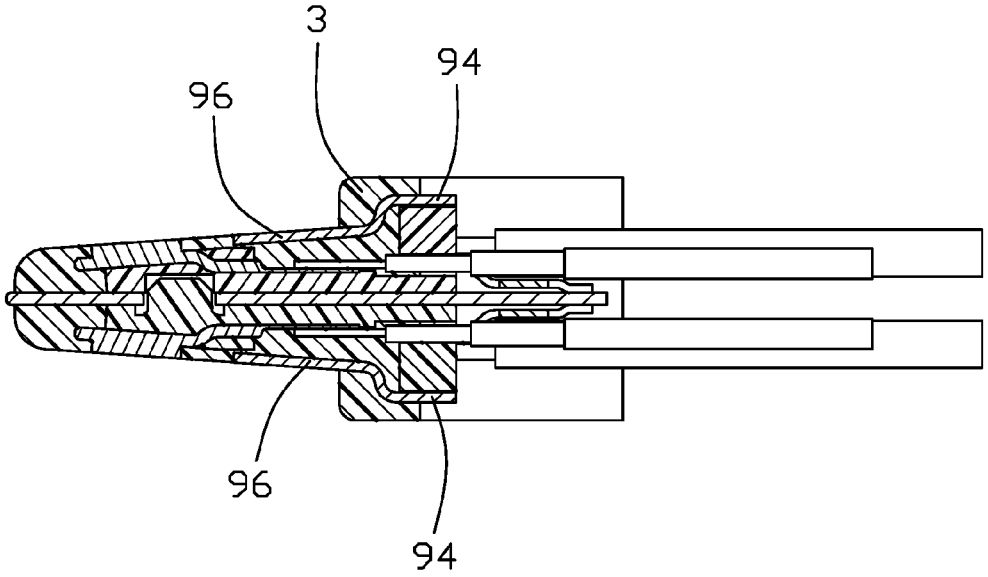
FIG. 33 is a cross-sectional view of the electrical cable connector of FIG. 25.
Figure 34:
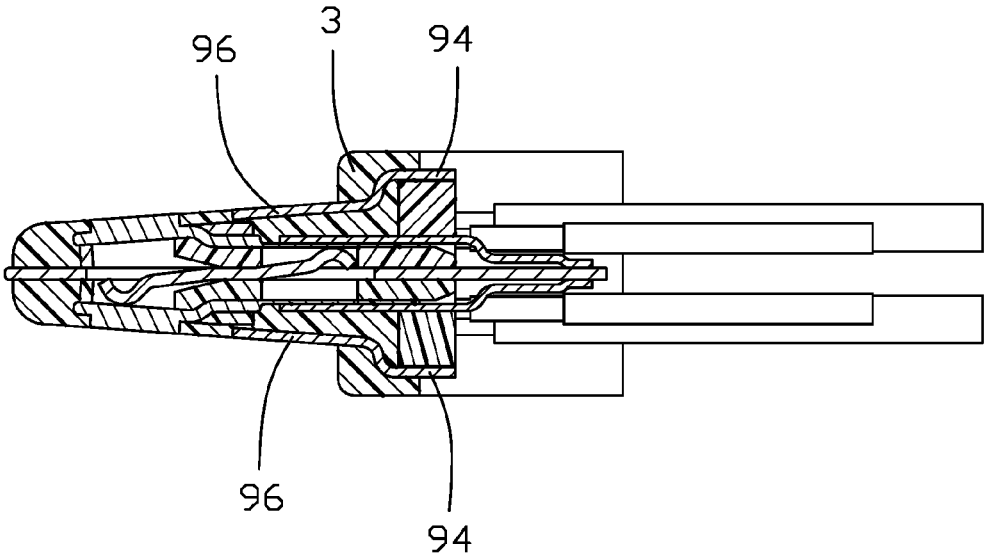
FIG. 34 is another cross-sectional view of the electrical cable connector of FIG. 25.

FIGS. 13-24 disclose a second embodiment similar to the first embodiment disclosed in FIGS. 1-12 wherein the front nose section of the mating tongue directly faces the openings 511 in the front-to-back direction as shown in FIG. 24, compared with the front nose section of the mating tongue is spaced from the openings 511 by the front end region of the insulator 5 as shown in FIG. 12. Understandably, the front nose section in this embodiment should be implemented in a dedicate manner or could be separately formed with regard to other portions of the base.

FIGS. 25-34 disclose a third embodiment similar to the first embodiment except with a pair of additional external shielding shells 90 each having a pair of legs 92 seated upon the shielding plate 6, and an elongated bar 94 linked between the pair of legs 92 in the transverse direction to press the pressing block 8 upon the corresponding insulator 6, and a grounding area 96 forwardly extending from the elongated bar 94 and spaced from the connecting section 43 in the vertical direction, and located behind the contacting section 42 in the front-to-back direction wherein the shielding shells 90 are embedded within the insulative base 3 via the over-molding process. Another difference between the third embodiment and the first embodiment is that in the third embodiment both the pressing block 8 and the shielding shells 90 extend rearward beyond the rear end face of the base while in the first embodiment the pressing block is terminated in front of the rear end surface 321 of the base 3.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical cable connector comprising:

a contact module including a pair of terminal modules commonly sandwiching a metallic shielding plate therebetween in a vertical direction;

each of said terminal modules including a plurality of terminals disposed in an insulator, said terminals being categorized with grounding terminals and paired signal terminals alternately arranged with each other along a transverse direction perpendicular to said vertical direction, each of said terminals including a front contacting section and a rear connecting section along a front-to-back direction perpendicular to both said vertical direction and said transverse direction;

the shielding plate forming a plurality of front spring fingers selectively connecting to the corresponding contacting section of the grounding terminals in one of the pair of terminal modules, and a plurality of rear fingers selectively connecting to the corresponding connecting section of the grounding terminals in the other of the pair of terminal modules; and a plurality of signal wires located behind the contact module, each of the wires including an inner conductive, an inner insulator, a metallic braiding layer and an outer insulator concentrically arranged with one another in sequence; wherein the inner conductors are soldered upon the corresponding connecting sections of the signal terminals, respectively.

2. The electrical cable connector as claimed in claim 1, wherein the connecting section defines opposite outer and inner surfaces with regard to the shielding plate, and the rear spring finger is connected to the inner surface of the corresponding connecting section while the inner conductor is soldered upon the outer surface of the corresponding connecting section.

3. The electrical cable connector as claimed in claim 1, wherein each of said terminal modules further includes a metallic grounding bar having a main body soldered with the corresponding braiding layers of the signal wires, a plurality of first arms forwardly extending from the main body to connect to the corresponding connecting sections of the grounding terminals, respectively.

4. The electrical cable connector as claimed in claim 3, wherein the first arms and the rear spring fingers are respectively located by two opposite inner and outer surfaces of the corresponding connecting sections, and commonly sandwich the corresponding connecting sections therebetween, respectively.

5. The electrical cable connector as claimed in claim 3, wherein the signal wires and the first arms are alternately arranged with each other along said transverse direction.

6. The electrical cable connector as claimed in claim 3, wherein each of said terminal modules further includes an insulative pressing block cooperating with the corresponding insulator to commonly sandwich the corresponding signal wires therebetween in the vertical direction.

7. The electrical cable connector as claimed in claim 6, wherein said pressing block cooperates with the corresponding insulator to commonly sandwich the first arms therebewtween in the vertical direction.

8. The electrical cable connector as claimed in claim 3, wherein the grounding bar further forms a plurality of second arms extending rearward from the corresponding main body to mechanically and electrically connecting to the shielding plate.

9. The electrical cable connector as claimed in claim 3, further including an insulative base applied upon the pair of terminal modules to cover the inner conductors and the first arms.

10. The electrical cable connector as claimed in claim 9, further including a pair of metallic shielding shells integrally formed with the insulative base, wherein said shell is located behind the contacting sections in the front-to-back direction and spaced from the connecting sections in the vertical direction.

11. The electrical cable connector as claimed in claim 10, wherein the pair of shielding shells are mechanically and electrically connected to the shielding plate.

12. An electrical cable connector comprising: a contact module including a pair of terminal modules commonly sandwiching a metallic shielding plate therebetween in a vertical direction; each of said terminal modules including a plurality of terminals disposed in an insulator, said terminals being categorized with grounding terminals and paired signal terminals alternately arranged with each other along a transverse direction perpendicular to said vertical direction, each of said terminals including a front contacting section and a rear connecting section along a front-to-back direction perpendicular to both said vertical direction and said transverse direction; the shielding plate forming a plurality of front spring fingers selectively connecting to the corresponding contacting section to the grounding terminals in one of the pair to terminal modules, and a plurality of rear fingers selectively connecting to the corresponding connecting section of the grounding terminals in the other of the pair of terminal modules; and a plurality of signal wires located behind the contact module, each of the wires including an inner conductive, an inner insulator, a metallic braiding layer and an outer insulator concentrically arranged with one another in sequence; wherein the inner conductors are soldered upon the corresponding connecting sections of the signal terminals, respectively; wherein an insulative base is applied upon the pair of terminal modules to cover the inner conductors via an over-molding process.

13. The electrical cable connector as claimed in claim 12, wherein each of said terminal modules further includes a grounding bar having a plurality of forwardly extending arms connected to the corresponding connecting sections of the grounding terminals, respectively.

14. The electrical cable connector as claimed in claim 13, wherein said spring fingers and said forwardly extending first arms cooperatively sandwich the corresponding connecting sections therebetween in the vertical direction, respectively.

15. The electrical cable connector as claimed in claim 13, wherein said grounding bar is mechanically and electrically connected to the shielding plate.

16. The electrical cable connector as claimed in claim 13, wherein the braiding layers of the signal wires are mechanically and electrically connected to the grounding bar.

17. The electrical cable connector as claimed in claim 13, further including a pair of metallic shielding shells combined with the contact module by two sides of the pair of terminal modules, respectively, by means of said insulative base via said over-molding process, wherein each of the shielding shells is electrically and mechanically connected to the shielding plate and located behind the contacting sections in the front-to-back direction, and spaced from the connecting sections in the vertical direction.

18. An electrical cable connector comprising: a contact module including a pair of terminal modules commonly sandwiching a metallic shielding plate therebetween in a vertical direction; each of said terminal modules including a plurality of terminals disposed in an insulator, said terminals being categorized with grounding terminals and paired signal terminals alternately arranged with each other along a transverse direction perpendicular to said vertical direction, each of said terminals including a front contacting section and a rear connecting section along a front-to-back direction perpendicular to both said vertical direction and said transverse direction; the shielding plate forming a plurality of front spring fingers selectively connecting to the corresponding contacting section of the grounding terminals in one of the pair terminal modules, and a plurality of rear fingers selectively connection to the corresponding connecting section of the grounding terminals in the other of the pair of terminal modules; a plurality of signal wires located behind the contact module, each of the wires including an inner conductive, an inner insulator, a metallic braiding layer and an outer insulator concentrically arranged with one another in sequence; and a pair of metallic grounding bars respectively located by opposite surfaces of the shielding plate; wherein each of said grounding bars mechanically and electrically connects to not only the braiding layers of the respective signal wires but also the connecting sections of the corresponding grounding terminals.

19. The electrical cable connector as claimed in claim 18, wherein the grounding bar includes a plurality of forwardly extending first arms contacting outer surfaces of the corresponding connecting sections while the spring fingers contacting inner surfaces of the corresponding connecting sections opposite to said first arms in the vertical direction, respectively.

20. The electrical cable connector as claimed in claim 19, wherein said ground bars are mechanically and electrically connected to the shielding plate.

* * * * *